US011484068B2

(12) United States Patent
Diaz et al.

(10) Patent No.: US 11,484,068 B2
(45) Date of Patent: Nov. 1, 2022

(54) FLAT-KNIT SUPPORT GARMENT FOR UPPER TORSO

(71) Applicant: NIKE, Inc., Beaverton, OR (US)

(72) Inventors: Josue Diaz, Portland, OR (US); Paul R. Montgomery, Portland, OR (US); Lori Sears, Portland, OR (US); Andrea J. Staub, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 751 days.

(21) Appl. No.: 16/447,438

(22) Filed: Jun. 20, 2019

(65) Prior Publication Data

US 2019/0297956 A1 Oct. 3, 2019

Related U.S. Application Data

(63) Continuation of application No. 15/341,788, filed on Nov. 2, 2016, now Pat. No. 10,368,590.
(Continued)

(51) Int. Cl.
*A41C 3/00* (2006.01)
*D04B 35/10* (2006.01)
(Continued)

(52) U.S. Cl.
CPC ..... *A41C 3/0014* (2013.01); *A41C 3/0085* (2013.01); *A41C 3/08* (2013.01); *A41C 5/00* (2013.01); *D04B 35/10* (2013.01)

(58) Field of Classification Search
CPC ..... A41C 3/0014; A41C 3/0085; A41C 3/08; D04B 1/246; D04B 1/06
(Continued)

(56) References Cited

U.S. PATENT DOCUMENTS 1,948,670 A 2/1934 Mueller
1,984,326 A 12/1934 Titone
(Continued)

FOREIGN PATENT DOCUMENTS

CN 1181428 A 5/1998
CN 1465303 A 1/2004
(Continued)

OTHER PUBLICATIONS

Intention to Grant received for European Patent Application No. 17723611.4, dated Dec. 8, 2021, 8 pages.
(Continued)

*Primary Examiner* — Timothy K Trieu
(74) *Attorney, Agent, or Firm* — Shook, Hardy & Bacon L.L.P.

(57) ABSTRACT

Aspects of a flat-knit support garment for an upper torso are provided. The flat-knit support garment may include a bra structure having a flat-knit bra material that includes a cup zone, a body zone, a wing zone, a strap zone, and a chestband zone. In some instances, a perimeter of the flat-knit bra comprising a neck opening and armhole openings includes a finished edge treatment corresponding to a high stretch modulus, covered yarn. Such finished edges are generated in seamless construction with the unitary, flat-knit structure of the flat-knit support garment for an upper torso. The flat-knit characteristics of the support garment for an upper torso may correspond to one or more of a flat-knit stitch sequence, a yarn type, and/or a finishing treatment.

20 Claims, 23 Drawing Sheets

Related U.S. Application Data

(60) Provisional application No. 62/250,316, filed on Nov. 3, 2015.

(51) Int. Cl.
*A41C 5/00* (2006.01)
*A41C 3/08* (2006.01)

(58) Field of Classification Search
USPC ..... 450/43; 66/176
See application file for complete search history.

(56) References Cited

U.S. PATENT DOCUMENTS

| | | | |
|---|---|---|---|
| 2,121,489 | A | 6/1938 | Rutledge et al. |
| 2,397,247 | A | 3/1946 | Davidson |
| 2,707,381 | A | 5/1955 | Lombardi |
| 2,899,812 | A | 8/1959 | Attenborough |
| 2,946,211 | A | 7/1960 | Morancy |
| 3,092,987 | A | 6/1963 | Levine |
| 3,167,938 | A | 2/1965 | Seiler |
| 3,241,340 | A | 3/1966 | Knohl |
| 3,389,580 | A | 6/1968 | Bentley et al. |
| 3,500,665 | A | 3/1970 | Braxton et al. |
| 3,537,279 | A | 11/1970 | Epley |
| 3,561,234 | A | 2/1971 | Mishcon et al. |
| 3,640,096 | A | 2/1972 | Betts et al. |
| 3,668,896 | A | 6/1972 | Betts et al. |
| 3,668,898 | A | 6/1972 | Betts et al. |
| 3,677,252 | A | 7/1972 | Pedley |
| 3,695,063 | A | 10/1972 | Betts et al. |
| 3,789,098 | A | 1/1974 | Cole et al. |
| 3,796,068 | A | 3/1974 | Betts et al. |
| 3,985,003 | A | 10/1976 | Reed |
| 4,019,350 | A | 4/1977 | Schmidt |
| 4,100,766 | A | 7/1978 | Kuhnert |
| 4,267,710 | A | 5/1981 | Imamichi |
| 4,311,150 | A | 1/1982 | Schreiber et al. |
| 4,356,710 | A | 11/1982 | Mizuno et al. |
| 4,419,997 | A | 12/1983 | Cole et al. |
| 5,120,264 | A | 6/1992 | Van Engel |
| 5,214,941 | A | 6/1993 | Essig |
| 5,359,865 | A | 11/1994 | So |
| 5,528,910 | A | 6/1996 | Azais |
| 5,787,503 | A | 8/1998 | Murphy, III |
| 5,887,451 | A | 3/1999 | Suzuki |
| 5,890,381 | A | 4/1999 | Leeke et al. |
| 5,916,272 | A | 6/1999 | Nonnenmacher et al. |
| 5,946,944 | A | 9/1999 | Osborne |
| 5,956,765 | A | 9/1999 | Chin |
| 6,089,052 | A | 7/2000 | Riegger |
| 6,178,784 | B1 | 1/2001 | Marley |
| 6,443,805 | B1 | 9/2002 | Kirkwood |
| 6,526,783 | B2 | 3/2003 | Sheu |
| 6,550,286 | B2 | 4/2003 | Querquant |
| 6,645,040 | B2 | 11/2003 | Rabinowicz et al. |
| 6,685,534 | B2 | 2/2004 | Mitchell et al. |
| 6,779,367 | B2 | 8/2004 | Mitchell et al. |
| 6,779,369 | B2 | 8/2004 | Shepherd |
| 6,824,445 | B2 | 11/2004 | Oneyear et al. |
| 6,899,591 | B2 | 5/2005 | Mitchell |
| RE38,853 | E | 10/2005 | Rabinowicz |
| 7,001,240 | B1 | 2/2006 | Huffman-Jimenez |
| 7,043,329 | B2 | 5/2006 | Dias et al. |
| 7,169,011 | B2 | 1/2007 | Mitchell et al. |
| 7,442,110 | B2 | 10/2008 | Gaudet et al. |
| 7,536,879 | B2 | 5/2009 | Vanwelden |
| 7,611,999 | B2 | 11/2009 | McMurray |
| 7,614,256 | B2 | 11/2009 | Mitchell |
| 7,716,954 | B2 | 5/2010 | Naka et al. |
| 8,128,457 | B2 | 3/2012 | Reinisch et al. |
| 8,226,452 | B2 | 7/2012 | Hendrickson |
| 8,398,453 | B2 | 3/2013 | Mitchell et al. |
| 8,469,769 | B2 | 6/2013 | Hendrickson |
| 8,550,872 | B2 | 10/2013 | Upton et al. |
| 8,640,503 | B2 | 2/2014 | Kunde et al. |
| 8,690,634 | B2 | 4/2014 | Heath et al. |
| 9,198,467 | B2 | 12/2015 | Gordon |
| 9,375,045 | B2 | 6/2016 | Farris et al. |
| 9,375,046 | B2 | 6/2016 | Meir |
| 9,405,205 | B2 | 8/2016 | De Graaf et al. |
| 9,538,794 | B2 | 1/2017 | Turlan |
| 10,145,042 | B2 | 12/2018 | Diaz et al. |
| 10,179,960 | B2 | 1/2019 | Diaz et al. |
| 10,415,164 | B2 | 9/2019 | Diaz et al. |
| 10,912,340 | B2 * | 2/2021 | Diaz ..... A41C 3/0014 |
| 2004/0097151 | A1 | 5/2004 | McMurray |
| 2004/0099016 | A1 | 5/2004 | Shepherd |
| 2004/0168479 | A1 | 9/2004 | McMurray |
| 2005/0115282 | A1 | 6/2005 | Starbuck |
| 2005/0255789 | A1 | 11/2005 | Gaudet et al. |
| 2006/0144097 | A1 | 7/2006 | Langer et al. |
| 2006/0243000 | A1 | 11/2006 | Turlan et al. |
| 2007/0238392 | A1 | 10/2007 | Starbuck et al. |
| 2008/0268217 | A1 | 10/2008 | Kanatani et al. |
| 2010/0184355 | A1 | 7/2010 | Kennedy |
| 2014/0068968 | A1 | 3/2014 | Podhajny et al. |
| 2014/0366585 | A1 | 12/2014 | Shen et al. |
| 2016/0242472 | A1 | 8/2016 | Turlan |
| 2016/0251782 | A1 | 9/2016 | Liao et al. |
| 2017/0119063 | A1 | 5/2017 | Diaz et al. |
| 2018/0317568 | A1 | 11/2018 | Diaz et al. |
| 2018/0317569 | A1 | 11/2018 | Diaz et al. |
| 2018/0317570 | A1 | 11/2018 | Diaz et al. |
| 2018/0320297 | A1 | 11/2018 | Diaz et al. |
| 2019/0055683 | A1 | 2/2019 | Diaz et al. |
| 2019/0345653 | A1 | 11/2019 | Diaz et al. |
| 2020/0109496 | A1 * | 4/2020 | Lucas Gaus ..... D04B 1/108 |

FOREIGN PATENT DOCUMENTS

| | | | |
|---|---|---|---|
| CN | 1668220 | A | 9/2005 |
| CN | 1758859 | A | 4/2006 |
| CN | 1833059 | A | 9/2006 |
| CN | 101313096 | A | 11/2008 |
| CN | 102657384 | A | 9/2012 |
| CN | 102770036 | A | 11/2012 |
| CN | 103046216 | A | 4/2013 |
| CN | 104131399 | A | 11/2014 |
| CN | 105133161 | A | 12/2015 |
| CN | 205285023 | U | 6/2016 |
| DE | 2036542 | A1 | 2/1972 |
| EP | 0261800 | A2 | 3/1988 |
| EP | 1449946 | A1 | 8/2004 |
| EP | 2952616 | A1 | 12/2015 |
| FR | 2852025 | A1 | 9/2004 |
| GB | 1574736 | A | 9/1980 |
| JP | 7-138850 | A | 5/1995 |
| JP | 3039099 | U | 6/1997 |
| JP | 10-24799 | A | 1/1998 |
| JP | 11-36106 | A | 2/1999 |
| JP | 2002-339206 | A | 11/2002 |
| JP | 2003-500558 | A | 1/2003 |
| JP | 2003-147607 | A | 5/2003 |
| JP | 2005-533197 | A | 11/2005 |
| JP | 2006-283250 | A | 10/2006 |
| JP | 2007-31849 | A | 2/2007 |
| JP | 2008-169533 | A | 7/2008 |
| JP | 2009-270216 | A | 11/2009 |
| JP | 2012-072513 | A | 4/2012 |
| JP | 3175485 | U | 5/2012 |
| JP | 2013-213304 | A | 10/2013 |
| JP | 5361320 | A | 12/2013 |
| JP | 2014-231665 | A | 12/2014 |
| KR | 96-16088 | U | 6/1996 |
| KR | 2001-0102182 | A | 11/2001 |
| KR | 2001-0112492 | A | 12/2001 |
| KR | 10-2014-0130027 | A | 11/2014 |
| TW | 201249358 | A | 12/2012 |
| TW | I479059 | B | 4/2015 |
| TW | I618828 | B | 3/2018 |
| WO | 00/71794 | A1 | 11/2000 |
| WO | 2005041702 | A2 | 5/2005 |

(56) References Cited

FOREIGN PATENT DOCUMENTS

| | | | |
|---|---|---|---|
| WO | 2011106014 | A1 | 9/2011 |
| WO | 2012/063316 | A1 | 5/2012 |
| WO | 2016197051 | A1 | 12/2016 |

OTHER PUBLICATIONS

Intention to Grant received for European Patent Application No. 17723847.4, dated Dec. 9, 2021, 8 pages.
Intention to Grant received for European Patent Application No. 17723848.2, dated Dec. 6, 2021, 8 pages.
Office Action received for Canadian Patent Application No. 3,004,052, dated Dec. 1, 2021, 3 pages.
Non-Final Office Action received for U.S. Appl. No. 16/523,017, dated Jul. 23, 2020, 7 pages.
Notice of Allowance received for U.S. Appl. No. 15/584,938, dated Aug. 6, 2020, 7 pages.
Office Action received for Sri Lankan Patent Application No. 20760, dated Dec. 28, 2020, 1 page.
Notice of Allowance received for Canadian Patent Application No. 3,054,797, dated May 3, 2021, 1 page.
Notice of Allowance received for Canadian Patent Application No. 3054723, dated May 4, 2021, 1 page.
Notice of Allowance received for U.S. Appl. No. 16/786,065, dated May 25, 2021, 6 pages.
Office Action received for Canadian Patent Application No. 3004052, dated May 5, 2021, 3 pages.
Final Office Action received for U.S. Appl. No. 15/584,938, dated Jan. 16, 2020, 7 pages.
International Search Report and Written Opinion received for PCT Patent Application No. PCT/US2019/052592, dated Dec. 16, 2019, 14 pages.
Notice of Allowance received for U.S. Appl. No. 16/166,378, dated Dec. 11, 2019, 5 pages.
Office Action received for Sri Lankan Patent Application No. 19856, dated Dec. 16, 2019, 1 page.
International Preliminary Report on Patentability received for PCT Patent Application No. PCT/US2019/052592, dated Apr. 15, 2021, 8 pages.
Non-Final Office Action received for U.S. Appl. No. 16/576,244, dated Apr. 1, 2021, 10 pages.
Notice of Allowance received for U.S. Appl. No. 16/523,017, dated Nov. 3, 2020, 5 pages.
Office Action received for Canadian Patent Application No. 3054723, dated Oct. 16, 2020, 3 pages.
Office Action received for Canadian Patent Application No. 3054797, dated Oct. 16, 2020, 3 pages.
Office Action received for Canadian Patent Application No. 3054919, dated Oct. 28, 2020, 3 pages.
Office Action received for Canadian Patent Application No. 3055024, dated Oct. 28, 2020, 3 pages.
Office Action received for European Patent Application No. 16805575.4, dated Aug. 17, 2020, 5 pages.
Zheng, Rong, Winnie Yu, and Jintu Fan, "Pressure evaluation of 3D seamless knitted bras and conventional wired bras," Fibers and Polymers 10.1 (2009): 124-131. http://www.researchgate.net/profile/Winnie_Yu/publication/225481465_Pressure_evaluation_of_3D_seamless_knitted_bras_and_conventional_wired_bras/links/54d029160cf24601c0964062.pdf.
"Leading Lady Seamless Knit Nursing Bra," Hanes®, hanes.com, Style #24304, accessed Oct. 12, 2015 http://www.hanes.com/hanes/onehanesplace/bra/shop-by-category/nursing-bras/leading-lady-nursing-bra-24304.
Simplicity Mother's Breast Feeding Maternity Nursing Bra Tank Top Camisole, Amazon, amazon.com, Accessed Oct. 2015 http://www.amazon.com/Simplicity%C2%AE-Womens-Maternity-Nursing-Sleeveless/dp/B00LQ1O8FK.
STOLL Performance Plus SS-2016-ES Brochure, ©2016 H. Stoll AG & Co., KG, Germany, 36 pages.
"Breast sizing and development of 3D seamless bra"; Rong Zheng; 2007 http://ira.lib.polyu.edu.hk/handle/10397/2619.
"Three Dimensional Seamless Garment Knitting On VBedFlat Knitting Machines"; Wonseok Choi et al. https://www.researchgate.net/publication/237482349_Three_dimensional_seamless_garment_knitting_on_V-bed_flat_knitting_machines.
Non-Final Office Action dated Jul. 25, 2019 in U.S. Appl. No. 15/584,938, 9 pages.
Office Action received for Canadian Patent Application No. 3054919, dated Mar. 25, 2022, 4 pages.
Office Action received for Sri Lankan Patent Application No. 20761, dated Nov. 30, 2020, 1 page.
International Preliminary Report on Patentability dated Nov. 14, 2019 in International Patent Application No. PCT/US2017/030859, 9 pages.
International Preliminary Report on Patentability dated Nov. 14, 2019 in International Patent Application No. PCT/US2017/030947, 9 pages.
International Preliminary Report on Patentability dated Nov. 14, 2019 in International Patent Application No. PCT/US2017/030861, 9 pages.
International Preliminary Report on Patentability dated Nov. 14, 2019 in International Patent Application No. PCT/US2017/030863, 8 pages.
Notice of Allowance received for Canadian Patent Application No. 3054919, dated Oct. 22, 2021, 1 page.S.
Office Action received for European Patent Application No. 17723849.0, dated Nov. 18, 2021, 8 pages.
Non-Final Office Action received for U.S. Appl. No. 17/142,487, dated Feb. 22, 2022, 9 pages.
Notice of Allowance received for Canadian Patent Application No. 3055024, dated Jun. 10, 2021, 1 page.
Office Action received for Canadian Patent Application No. 3054919, dated Jun. 22, 2021, 3 pages.
Notice of Allowance received for U.S. Appl. No. 16/576,244, dated Jul. 28, 2021, 5 pages.
Notice of Allowance received for U.S. Appl. No. 16/839,556, dated Sep. 8, 2021, 6 pages.
Notice of Allowance received for U.S. Appl. No. 17/142,487, dated Jun. 27, 2022, 5 pages.
Extended European Search Report received for European Application No. 22165673.9, dated Jul. 7, 2022, 9 pages.
Notice of Allowance received for Canadian Patent Application No. 3,004,052, dated Aug. 2, 2022, 1 page.
Office action received for European Patent Application No. 16805575.4, dated Aug. 9, 2022, 5 pages.

* cited by examiner

X

FLAT-KNIT SUPPORT GARMENT FOR UPPER TORSO

RELATED APPLICATION

This application is a continuation of and claims priority to U.S. Nonprovisional application Ser. No. 15/341,788, filed Nov. 2, 2016, which claims priority to U.S. Provisional Patent Application No. 62/250,316, filed Nov. 3, 2015, entitled "Flat-Knit Bra," the entire contents of each of which are hereby incorporated by reference.

SUMMARY OF THE INVENTION

This summary introduces a selection of concepts that are further described below in the detailed description. It is not intended to identify essential features of the claimed subject matter or to be used as an aid in determining the scope of the claimed subject matter. The present invention is defined by the claims.

At a high level, aspects herein are directed to a flat-knit garment for an upper torso of a wearer, such as a flat-knit support garment having one or more flat-knit support zones. In some aspects, the flat-knit support garment for an upper torso of a wearer includes a flat-knit bra, where the unitary bra structure includes integrated, flat-knit features for zonal support, shaping, modesty, and air permeability, and the flat-knit edges of the bra are free of surrounding textile. The exemplary flat-knit bra may be especially suitable for minimizing material waste in the construction of a unitary bra as the seamless flat-knitting process generates a completed knit structure that is not surrounded by a textile structure from which the bra must be removed. Further, the completed flat-knit garment with finished, flat-knit edges may be assembled with minimal seaming and/or optimized integration of at least one closure mechanism during finishing of the flat-knit garment.

In some aspects, the flat-knit bra material may include one or more zonal sequences of knitting throughout the flat-knit process with particular yarns isolated in particular zones, which vary both the support characteristics and the appearance of multiple portions. In another aspect, integrating flat-knit support structures, such as inlaid yarns of varying strengths, and changing stitch sequence and/or yarn type between adjacent flat-knit zones, may provide for additional customization of the flat-knit support garment.

BRIEF DESCRIPTION OF THE DRAWINGS

The present invention is described in detail below with reference to the attached drawing figures, wherein.

DETAILED DESCRIPTION

Figure 1:
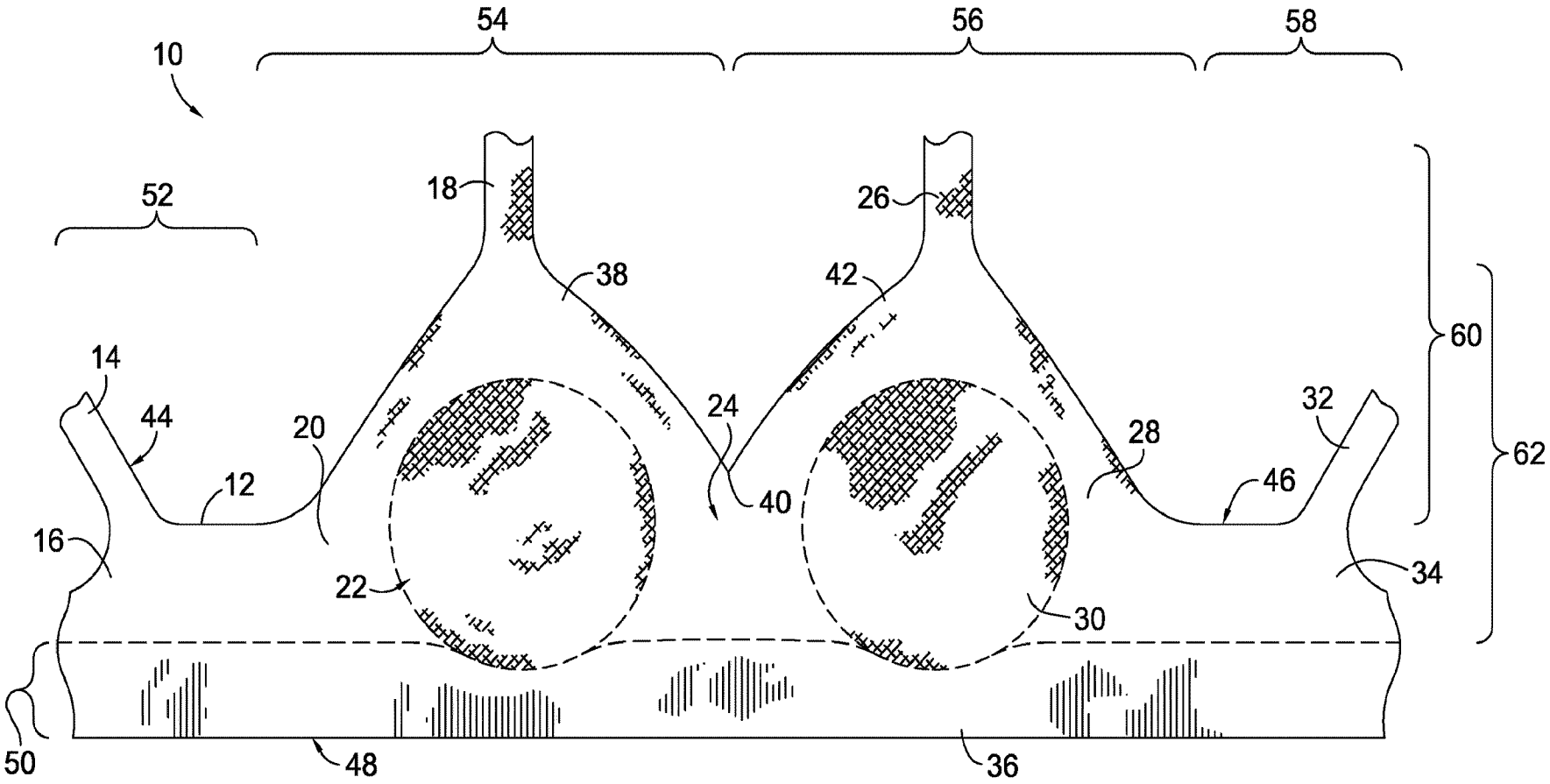
FIG. 1 depicts a top view of a flat-knit bra in accordance with various aspects.

The subject matter of the present invention is described with specificity to meet statutory requirements. However, the description itself is not intended to limit the scope of aspects described herein. Rather, it is contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Various aspects are described with reference to a support garment for an upper torso. Some examples are described with respect to a "bra," which may refer to any garment configured to provide support to an upper torso of a wearer, and in particular, support to at least a portion of a wearer's breasts. That is, a flat-knit bra may refer to an upper torso support garment having specific support zones that are flat knitted into the garment and in some instances, may perform similar functions to that of a sewn-together support garment (e.g., a "cut and sewn" bra configuration). For example, an aspect of a flat-knit bra may include a camisole garment having integrated flat-knit features for supporting a wearer's breasts. Similarly, a base layer shirt or other upper torso garment having flat-knit support features, such as the pair of zonal, flat-knit bra cups described here, may include seamless, flat-knit aspects.

One or more integrated features of a flat-knit upper torso support garment provide the supportive aspects of a bra within a seamless, flat-knit material. In some aspects, an integrated feature may refer to a specific yarn type or specific stitch type that is knitted in the continuous bra body—i.e., "integrated" with the surrounding flat-knit stitches. For example, an integrated feature may refer to an integrated yarn (e.g., a particular yarn material having a particular tensile strength) that is knitted with the surrounding flat-knit structure of the bra, in seamless construction with one or more other integrated features of the flat-knit bra material.

In further aspects, an integrated support structure created with flat-knitting of one or more yarns to produce dimension within the bra material. Such dimension may be referred to as "shaping" and/or displacing a zone of the flat-knit bra with respect to an adjacent, flat-knit zone having different integrated features. Generating such integrated support structures within the flat-knit bra may include, in some aspects, forming the flat-knitted material by knitting in a continual, "integrated" manner with the surrounding bra portions (i.e., seamless construction of the flat-knit bra). Accordingly, aspects of one or more integrated, flat-knit features refers to a seamless construction of the flat-knit bra material during one or more changes in yarn content, one or more changes in stitch structure, and one or more changes in the construction of integrated support structures (e.g., flat-knit bra cups), each integrated flat-knit feature having a particular function within the support garment. As such, without changing knitting machines or inserting separate materials or garment components, the flat-knit bra may include specific, integrated features according to a specific bra's dimensions and/or proportions, while maintaining the unitary structure and/or ready-to-wear features created via flat-knitting technology.

In another example, an integrated support structure may correspond to a variety of different zones within the flat-knit bra. For example, the bra cup region may include an integrated support structure that provides lift, such as integrated yarns or stitches in a bra hammock. In another example, the bra strap region may include an integrated support structure that provides resistance to elongation, lockout, and/or other support characteristics, adjustable or stationary, that supplement the existing stitches of that particular zone. Accordingly, aspects are described below for exemplary flat-knit bra configurations having flat-knit zones characterized by the one or more integrated features within those zones, such as a cup region characterized by a particular stitch sequence that generates shaping, and a particular yarn that produces a material having a desired stretch modulus. In another aspect, a bra body may include a common yarn and/or common stitch sequence throughout the entire flat-knit bra, with additional, integrated flat-knit features in particular zones, such as the cup zone, strap zone, body zone, chestband zone, wing zone, etc. The integrated, flat-knit features therefore may enhance the properties of an otherwise consistent material construction, imparting increased or decreased stretch characteristics or structural characteristics to zones at various locations within the flat-knit bra.

In some aspects, the integrated features of the flat-knit bra may facilitate the construction of a pre-molded, pre-shaped bra material for later molding. For example, the flat-knit bra having a flat-knitted amount of dimension within one or more zones of the bra may be treated with a particular molding technique during finishing of the flat-knit bra. Because of the stress and strain on the flat-knit bra material caused by such heat treatment and molding, aspects of the flat-knit bra facilitate molding and reduce at least a portion of the stress on the flat-knit bra material. In some instances of shaping a bra, the cup area may be molded using a mold structure with a particular depth corresponding to the desired final cup proportions. However, based on pre-shaping the flat-knit bra with various integrated features (i.e., yarn changes, stitch changes, knitted support structures, short row shaping, etc.), the flat-knit bra material may be molded using a more shallow mold structure that mates to the pre-shaped flat-knit bra structure, thereby protecting the bra during heat treatment and/or molding. A resulting finished, flat-knit bra may include a molded cup area that was initially formed via pre-shaped flat knitting of the cup zone, and further formed during heated molding of the cup zone with a mold having a minimal height corresponding to the pre-shaped cup zone.

In some aspects, the mold corresponding to the pre-shaped, flat-knit bra includes a low-profile mold that may be less likely to damage (i.e., tear apart) the material being molded, and in particular, the material proximate a boundary of the molded feature. The modified mold structure (i.e., reduced scale of the requisite mold size) may cause less tearing of the pre-shaped material, require less heat applied to generate shaping of an already pre-shaped material, and is less likely to damage the bra material during treatment as compared to molding a flat-knitted bra (with or without pre-shaping) on a regular-profile mold. Further, by preserving the stability of the flat-knitted bra material during molding, a targeted application of heat molding may be applied to the flat-knitted, pre-shaped zones within the bra. Additionally, molding of the pre-shaped, flat-knitted cup zone may provide for minimized tearing of the material along the boundary where the heat treatment is applied, thereby enabling zonal application of shallower (i.e., less damaging) heat molding devices (e.g., at lower temperatures and/or shorter duration) to one or more pre-shaped, flat-knitted zones with seamless construction, and optimizing the post-processing treatment of the flat-knit bra, in some aspects.

Additional examples of optimized post-processing treatments for the flat-knit bra include integrally knitting the edges of the bra using uncovered Spandex, which provides a "binding" structure along the armhole and neckline portions of the bra. In other words, no additional binding is needed along the edges of the finished, flat-knit bra, such as a sewn-on binding or separate trim piece. Similarly, the flat-knit chestband zone is integrally knit with the adjacent flat-knit material such that an additional sewn-on elastic trim may not be needed, in some aspects. In some instances, the integral chestband and/or integral stretch edge of the flat-knit bra facilitates an optimized assembly time for the flat-knit bra, which might otherwise require additional time to apply edges, trim, binding, bands, elastic, and the like. By changing a bra body yarn to a high-stretch yarn, for example, the perimeter of the bra may become more resilient, easier to maintain shape, and finished without requiring additional processing.

In some aspects, post-processing may also be minimized using partial knitting to create depth within one or more portions of the bra cup zones. As such, aspects of the flat-knit bra may utilize partial knitting to build up material where an otherwise cut-and-sew bra may include a separate molded spacer fabric sewn into the cup, providing encapsulation and support. In other examples, partial knitting may be used within a zone of the bra, such as the cup zone, to generate shaping to the final structure that is used as a pre-shaped guide for later molding.

In further aspects, the flat-knit edges around a perimeter of flat-knit support garment are constructed free of surrounding textile structure. Without surrounding textile structure, the flat-knit support garment may be created without the need to cut and/or remove excess material. In one aspect, the "flat-knit edge" may refer broadly to a bounded, cast-off, and/or finished knit edge, such as a flat-knit edge that maintains structure when exposed (i.e., does not unravel). During the flat knitting of the outer perimeter and/or edge of the material directly adjacent one or more flat-knit zones (having one or more integrated features) within the bra, a flat-knit edge may be knitted as a continuous structure with the multiple rows of knitting along the bra. For example, the flat-knit bra may include a unitary, flat-knit construction, which may refer to having all flat-knitted content of the bra, including a continuous structure that maintains material stability between rows of knitting, types of yarns, changes in zonal support regions, and a surrounding flat-knit edge. At least a portion of the same set of flat-knit needles may be used to generate the seamless transition from yarns of the various bra material zones having particular yarn characteristics, to yarns of the flat-knit edge, having another yarn feel. As such, the flat-knit edge having a specific tactile characteristic different than at least a portion of the other flat-knit bra material, may be referred to as a perimeter finish and/or a "stretch edge" of the flat-knit bra.

In one aspect, a bra of unitary construction includes a flat-knit textile element having flat-knit edges free of surrounding textile structure such that the flat-knit edges are not surrounded by textile structure from which the textile element is removed. Further, the flat-knit textile element includes at least a first bra support zone and a second bra support zone. Various portions of the flat-knit bra may include specific yarns for performance within each zone of the central, flat-knit bra material (i.e., bra body, bra straps, bra wings, and bra cups, etc.) and specific yarns for performance along a perimeter, stretch edge flat-knitted in unitary construction with the flat-knit bra body. It is understood that such perimeter stretch zone is considered to be part of the flat-knit bra, is not a separate or sewn-on element, and is not a removable textile from around the unitary, flat-knit bra. In other words, the perimeter of the flat-knit bra includes a stretch edge that is flat knitted at the same time.

In another aspect, a flat-knit zonal support bra includes a bra cup area formed of a first stitch configuration, the first stitch configuration having a plurality of flat-knit stitches that provide a first stretch property to the bra cup area. The flat-knit zonal support bra further includes a bra strap area formed of a second stitch configuration, said second stitch configuration different from said first stitch configuration, the second stitch configuration having a plurality of flat-knit stitches that provide a second stretch property to the bra strap area. Additionally, the bra includes a bra base area formed of a third stitch configuration and in unitary construction with both the first stitch configuration and the second stitch configuration, the third stitch configuration having a plurality of flat-knit stitches that provide a third stretch property to the bra base area. In some aspects, the unitary construction of the bra cup area, bra strap area, and bra base area comprises flat-knit edges free of surrounding textile structures such that the flat-knit edges are not surrounded by textile structure from which the flat-knit zonal support bra must be removed.

Accordingly, a flat-knit bra may be formed from a single, flat-knit shape that comes off of a flat-knitting machine with a unitary knit construction including the bra cups, sides, front strap portions, back strap portions, and back of the bra. In such flat-knit orientation, the bra may be assembled for later closure of at least one seam to join the sides of the flat-knit body into a tubular structure. Such closure may include a closure feature, coupled to the flat-knit bra on at least a portion of the flat-knit bra material. The closure feature may provide an opened and closed position for the bra structure, such as an opening along the back of the flat-knit bra, an opening proximate one or more of the final assembly seams of the flat-knit bra material, and a closure mechanism proximate a midline front or midline back of the bra.

Further, based on the flat-knit orientation of the front and back strap portions, additional assembly aspects may include attaching a front strap portion to a back strap portion. In another aspect, a single strap portion of the flat-knit bra base may include a complete length of the strap that, once assembled, provides strap structure on both a front and a back side of a wearer. As such, in one aspect, a flat-knit bra base may include left and right portions that are joined in a tubular structure, and one or more strap portions that are joined to complete an armhole structure. In further aspects, the flat-knit bra may be strapless, having a unitary construction of bra cups, sides, and back, with flat-knit edges and no strap features.

In one aspect, corresponding front and back strap portions may be coupled to an intermediate strap portion that is separate from the base flat-knit bra structure. The intermediate strap portion is one example of joining the front and back knitted strap features from a flat-knit bra structure. In another aspect, front strap portions that are flat-knit into the bra structure may be joined to a back panel and/or insert, such as a racerback panel having attachment points for the flat-knit finished edges of the strap features on the flat-knit bra structure. In further aspects, a back panel/insert may also include attachment points for underarm features of the flat-knit bra structure.

While including multiple integrated features in a top that supports a wearer's breasts, the flat-knit bra may have a solid garment construction requiring minimal assembly. Further, the flat-knit bra may have additional characteristics throughout the unitary structure based on stitch placement and yarn type, whether functional, structural, and/or decorative, having a ready-to-wear, finished flat-knit edge that is free from surrounding structure upon flat-knitting. In one example, a first yarn having a first yarn property may be inserted in a first zone during flat-knitting, while a second yarn having a second yarn property may be inserted in a second zone adjacent to the first zone, switching between the first and second yarns utilizing the flat-knitting process. The types of yarns changed throughout the flat-knit bra may vary based on one or multiple characteristics. For example, the various yarns in the flat-knit bra may include multi-component yarns changed within a single or multiple zones, bi-composition yarns, multi-composition yarns, conductive yarns, yarns having particular electrical characteristics, yarns having particular melting properties responsive to variable heat treatments, yarns with varying gauges, multiple yarn sizes, engineered yarn materials, yarns with specific features and/or stretch characteristics, yarns having particular coloring features, color-changing yarns, fast-drying yarns, moisture-wicking yarns, yarns of various sizes/denier, and the like.

In one aspect, a stretch property may refer to one or more characteristics of an area of the flat-knit bra that results from a particular yarn type, a particular yarn placement, a particular knit stitch, and a particular shaping feature of one or more stitches within the flat-knit bra. For example, one stretch property associated with one or more zones of the flat-knit bra may include a modulus of elasticity associated with the one or more zones. As such, different regions of the flat-knit bra may include different modulus of elasticity values, and hence demonstrate varying stretch properties corresponding to an amount of stretch. In another example, the flat-knit bra may include a particular amount of lockout in a particular region of the bra, thereby imparting a particular stretch property characterized by minimized stretch associated with that region. In further examples, a stretch property may refer to a resulting direction of stretch, amount of stretch, etc.

While flat-knitting the bra having various yarn properties within various flat-knit bra zones, a flat-knitting machine optimized for flat-knitting a bra may be utilized, according to some aspects. As such, a particular yarn may be inserted in a particular zone of the flat-knit bra. In one aspect, a flat-knit bra may be knitted to provide certain benefits, such as a resulting flat-knit material feel, fabric effect, finished surface, or other flat-knit benefits. In one example, a commercially available flat-knitting machine may be used to generate aspects of the flat-knit bra. For example, at least a portion of a flat-knit bra may be manufactured on a commercially available flat-knitting machine having a gauge within 14-18 stitches per inch or a gauge greater than 14 stitches per inch, or greater than 16 stitches per inch, or greater than 18 stitches per inch (e.g., 21-gauge), etc. In another aspect, at least a portion of a flat-knit bra may be manufactured on a commercially available flat-knitting machine having a specific gauge corresponding to a particular flat-knit bra property. For example, a flat-knitting machine having a gauge with a number of stitches per inch optimized for a particular zone and/or particular yarn type may be utilized to create a flat-knit bra. Accordingly, one or more regions of a flat-knitted bra contemplated herein may have a stitch density greater than a threshold based on a gauge of a flat-knitting machine used to stitch the one or more regions: e.g., one or more regions may have a stitch density greater than 14, 16, or 18 stitches per inch. It is contemplated that additional or alternative flat-knitting machines may be utilized, in some aspects, such as a flat-knitting machine having higher gauge and/or specific mechanisms optimized for generating a flat-knit bra.

Aspects of the flat-knit bra are provided below, with reference to the different features described in FIGS. 1-11. In a first example, FIG. 1 depicts a top view of a flat-knit bra 10 having a garment body 12 with a back left strap 14, a back left torso portion 16, a front left strap 18, a front left torso portion 20, a left bra cup 22, a chest center portion 24, a front right strap 26, a front right torso portion 28, a right bra cup 30, a back right strap 32, and a back right torso portion 34, which are integrated together in a unitary construction that comes off of a flat-knitting machine with finished flat-knit edges. In further aspects, the flat-knit bra 10 includes an integrated, flat-knit chest band 36, flat-knit neckline edges 38 and 42 oriented adjacent to a bra middle 40.

Based on knitting each portion of the flat-knit bra 10 using a flat-knitting machine, the flat-knitted rows providing the bra straps, such as the back left strap 14, include a finished edge 44 that is unbroken and joined from one row to the next. Similarly, the flat-knitted rows providing the underarm portions, such as the back right torso portion 34, include a finished edge 46 that is already bound/finished. In another example, the flat-knitted rows providing the chest support band portion of the flat-knit bra, such as the chest band 36, include a finished edge 48 in seamless construction with the remaining bra material.

In one aspect of the zonal, flat-knit bra 10, a lower zone 50 secures the flat-knit bra 10 on a wearer by preventing shifting of the assembled garment body 12 (i.e., assembled into a tubular structure), and may include one or more different types of yarns and/or different types of stitches. For example, the lower zone 50 may include a flat-knit chest band 36 having a plurality of stitches configured to create lockout of the stretch properties within the chest band 36, a variable yarn type having different stretch properties with respect to the remaining garment body 12, or a combination of both stitch configuration and yarn type to alter the flat-knit bra 10 structure, stretch features, and/or lockout characteristics of the lower zone 50.

In further aspects, the middle zone 62 may secure the middle to upper chest portion of a wearer, such as the wearer's breasts supported by left and right bra cups 22 and 30. In one example, the middle zone 62 may include integrated flat-knit structures for support and/or shaping, specific yarn types isolated and flat-knitted within one or more areas that vary the stretch characteristics or appearance of the bra, and/or specific stitch types such as doubled or dropped stitches that may each alter the flat-knit bra 10 structure, stretch features, and/or lockout characteristics of the middle zone 62. In some aspects, the left bra cup 22 and the right bra cup 30 may include cup shaping that adds dimension to the flat-knit bra 10 extending from the plane of the surrounding flat-knit bra 10, such as a three-dimensional (3-D) feature of the bra 10. As such, while the shaping stitches and/or shaping yarn incorporated in one or both of the bra cups provide dimension to the overall finished bra structure, they may be flat-knit in unitary construction with adjacent garment portions, such as the left torso portion 20, the center chest portion 24, and the right torso portion 28. In one example, the dimension added to the flat-knit bra may include a stitched area having a depth between 0.1 centimeters and 2.0 centimeters. In some aspects, the added stitch density/depth adding dimension to the flat-knit bra may correspond to a number and type of stitches, yarns, or a combination of both stitches and yarn types to extend the material of the flat-knit bra beyond the plane of the surrounding bra body.

In yet another aspect, one or more flat-knit features of the upper zone 60 may secure the flat-knit bra 10 on a wearer's breasts by positioning the middle zone 62 and/or the bottom zone 50 with respect to the wearer's shoulders. For example, upon joining the back left strap 14 to the front left strap 18, and the back right strap 32 to the front right strap 26, the upper zone 60 may provide a wearable garment having a flat-knit unitary construction.

As further shown in FIG. 1, the various flat-knit features of the garment body 12 may be referred to with respect to a left portion 52, a left center portion 54, a right center portion 56, and a right portion 58. In one aspect, the left portion 52 and the right portion 58 may include one or more features that are flat-knit to provide a particular stretch characteristic to the flat-knit bra 10, and may be later directly or indirectly coupled together in a tubular orientation. In some aspects, the stretch characteristics of the left portion 52 and right portion 58 may vary with respect to the left center portion 54 and the right center portion 56. In one example, the left portion 52 and right portion 58 may include flat-knit stitches that provide lockout characteristics of at least a portion of the garment body 12. In another aspect, the left center portion 54 and right center portion 56 may include particular stitches, particular yarn types, and/or particular support structures that are flat-knit into a single base of the garment body 12 and provide support, resistance to stretch, contoured shaping for securing a wearer's breasts, and other integrated features of a flat-knit bra 10.

Figure 2:
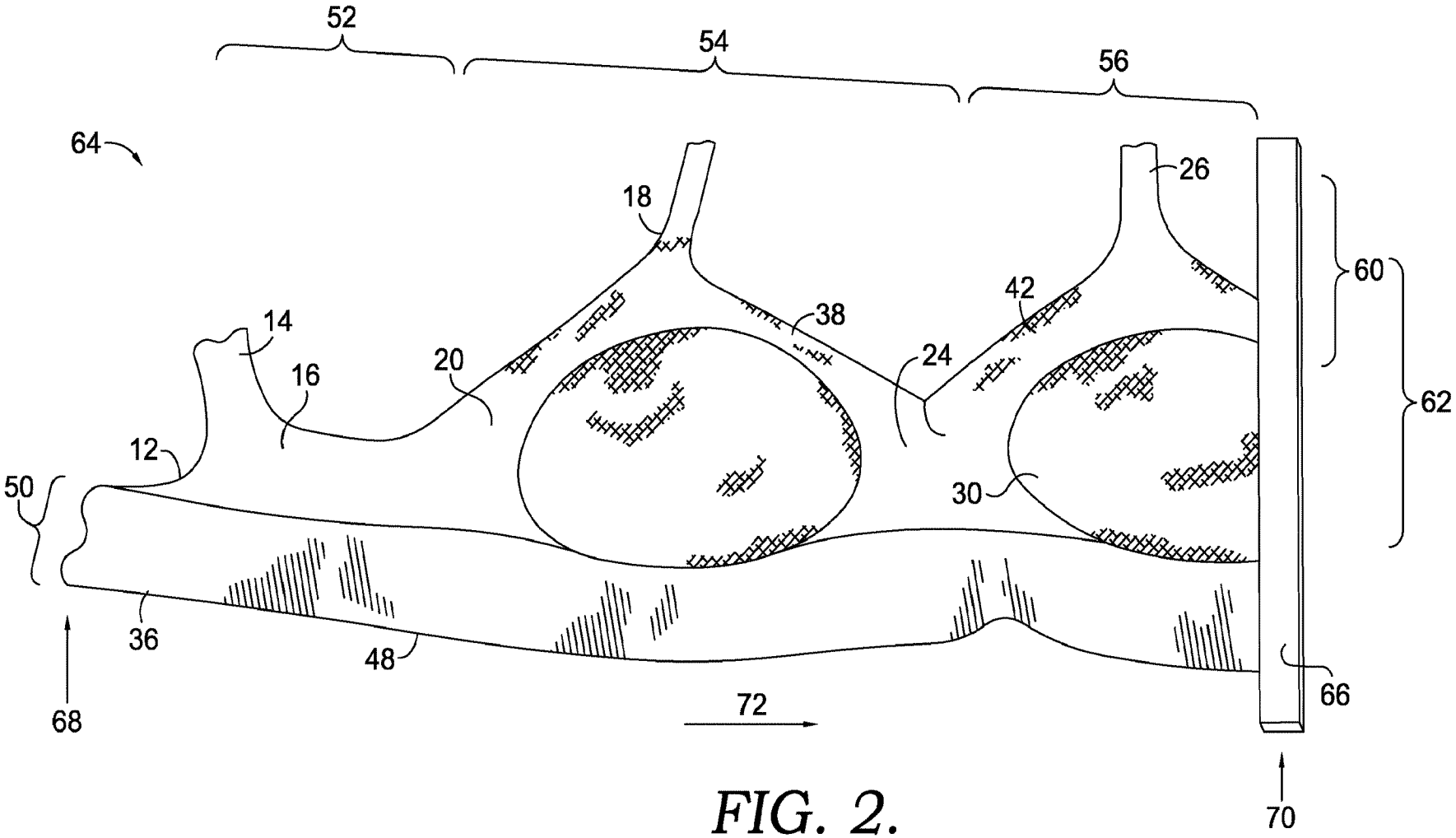
FIG. 2 depicts a front, perspective view of a flat-knit bra knitted across a garment width, in accordance with various aspects.

The various zones/portions described with respect to FIG. 1 may vary based on numerous configurations of the flat-knit bra 10, such as enlarged or diminished portions of the bra for targeted shaping, support, wearer sizing, or venting. Similarly, orientation of the garment body 12 may vary during the flat-knitting process, such as between a horizontal and a vertical orientation with respect to the garment body 12. As shown in FIG. 2, a front, perspective view of a flat-knit bra 64 is knitted in a vertical orientation, with a flat-knitting machine 66 knitting from the starting edge 68 towards the working edge 70, along the direction of knitting 72. In another aspect, as shown in FIG. 3, the flat-knit bra 74 may be knitted in a horizontal orientation, with the flat-knitting machine 66 knitting from the starting edge 78 towards the working edge 80, along the direction of knitting 76.

Figure 3:
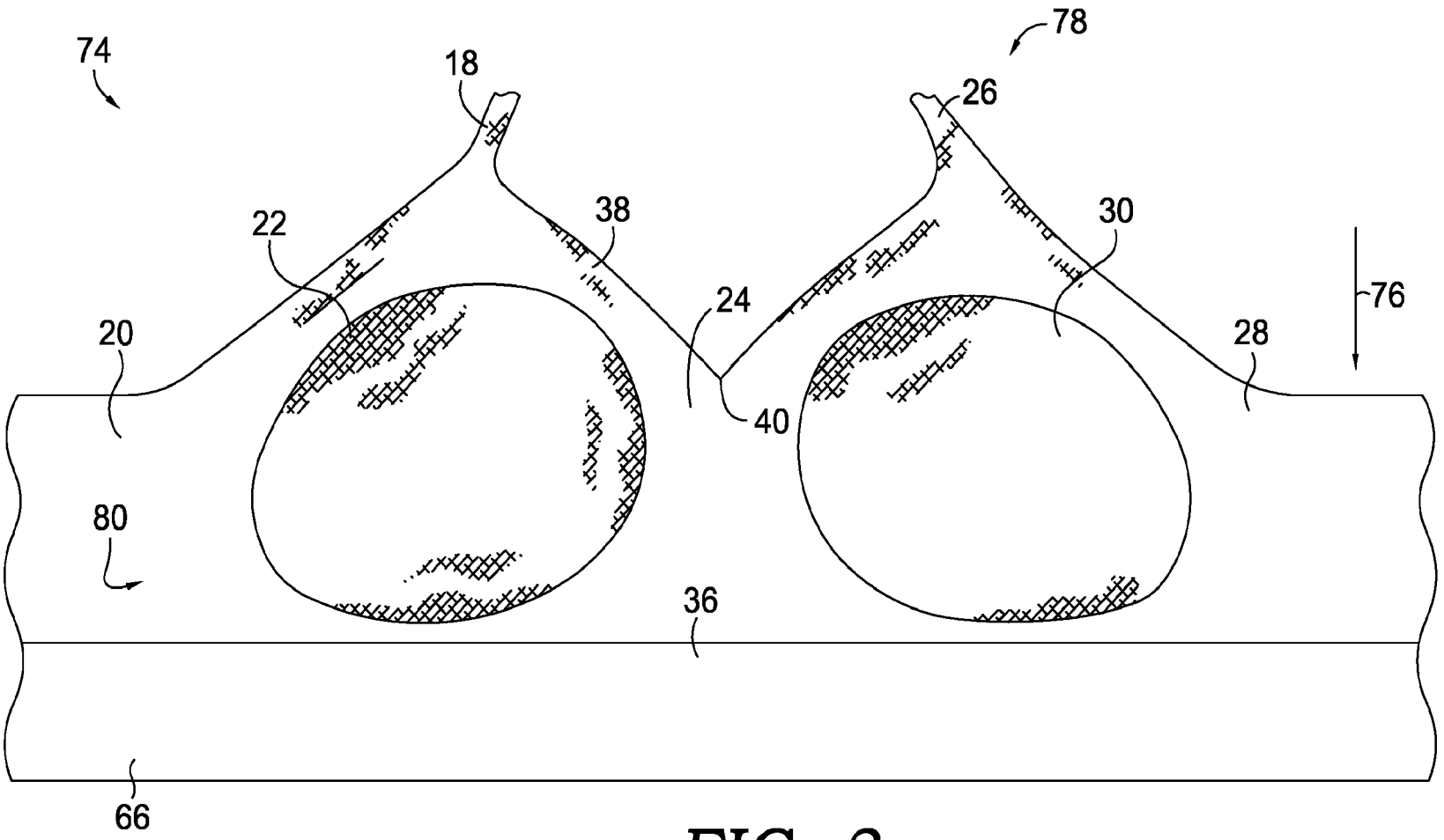
FIG. 3 depicts a front, perspective view of a flat-knit bra knitted across a garment height, in accordance with various aspects.
Figure 4:
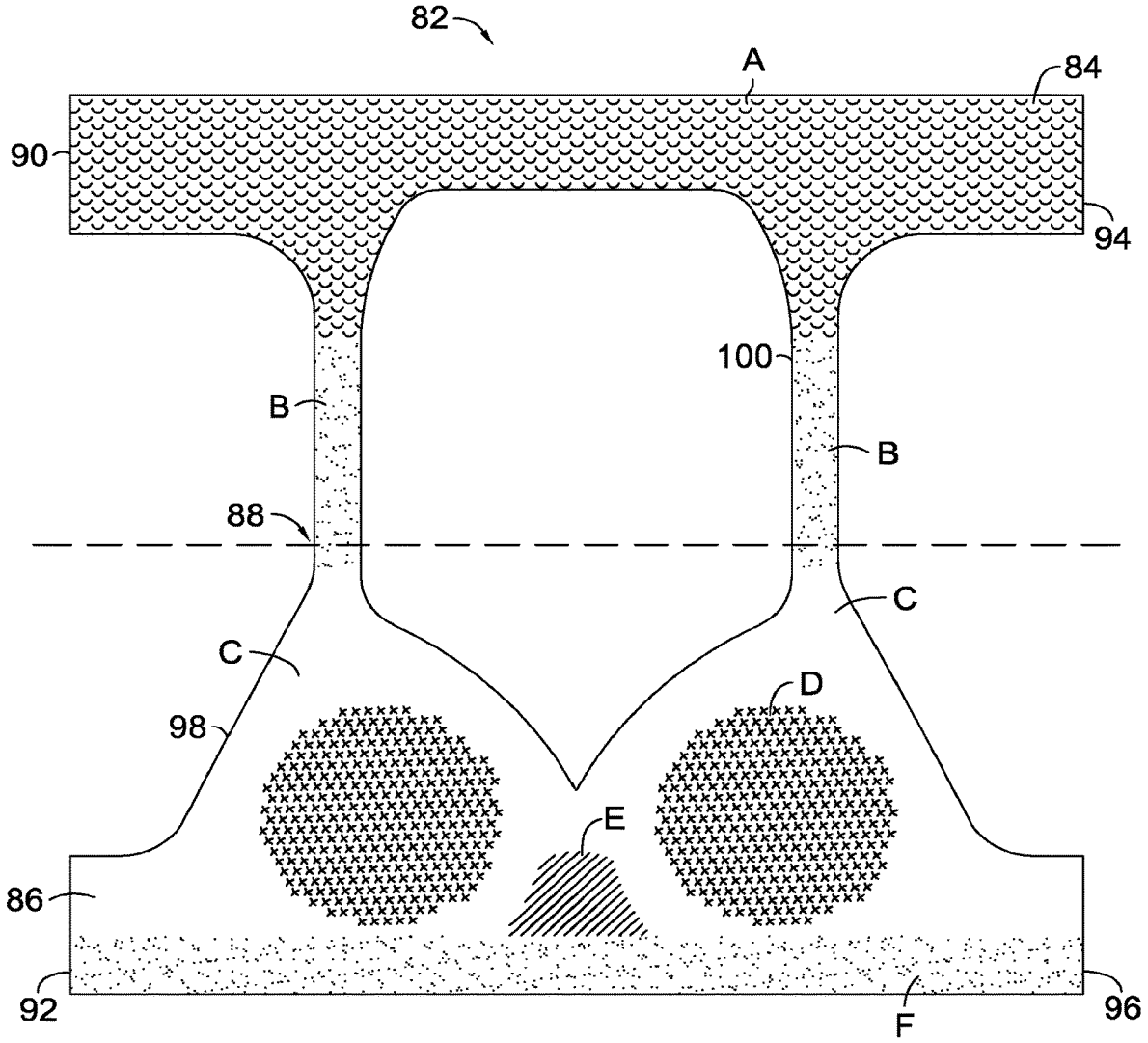
FIG. 4 depicts a top view of a flat-knit bra with zonal flat-knit features, finished flat-knit edges, and a neck opening (single aperture), in accordance with various aspects.

While aspects are described in FIGS. 1-3 as having both bra front and bra back features flat-knitted along a single axis, in further aspects, the flat-knit features of the garment body 12 may be rearranged in a variety of orientations to provide a unitary structure for flat-knitting additional exemplary bra structures. For example, FIG. 4 depicts a top view of an exemplary flat-knit bra 82 with zonal flat-knit features A, B, C, D, E, and F, an outer flat-knit edge 98, and a fit aperture 100. In this example, the back portion 84 is flat-knitted with the front portion 86 and may be assembled for wear by folding along fold line 88 and joining first edge 90 with second edge 92, and third edge 94 with fourth edge 96. Additionally, based on the flat-knitted construction of the bra 82, the outer flat-knit edge 98 and the inner flat-knit edge of the fit aperture 100 are both free from surrounding textile structure from which the bra 82 must be removed. In some aspects, a "fit aperture" may refer to any opening on or associated with the flat-knit bra that accommodates a wearer. For example, a fit aperture may refer to a neckline, neckhole, armhole, arm opening, sleeve structure, and the like. In one aspect, a fit aperture may be generated from at least a portion of a flat-knit bra front upon coupling to itself or to another material (e.g., a bra back) to form a neck hole and/or arm hole.

As further depicted in the example of FIG. 4, the flat-knit bra 82 may include a zonal feature A at a particular portion such as a back band. In one aspect, the zonal feature A may provide decreased stretch and/or lockout of one or more portions within zonal feature A, based on stitch type, yarn density, or a combination of stitch type and yarn density. Although depicted in FIG. 4 as having a consistent appearance throughout zonal feature A, isolated portions of the bra 82 may be engineered within zonal feature A that varies the stretch properties within the particular zone and with respect to the remaining bra 82 body. In another example, zonal feature B includes a particular stretch characteristic corresponding to bra straps, such as a lockout feature within zonal feature B based on stitch type, yarn density, or a combination of both stitch type and yarn density. In further aspects, flat-knit integrated structures of the zonal feature B may facilitate additional structural support in the strap region of the bra 82. As such, the straps in zonal feature B are joined in unitary construction with the zonal feature C portion of the bra 82. In zonal feature C, a specific stretch characteristic may be flat-knitted into the bra 82 to provide a desired fit, shaping, or customization of the bra 82. For example, the zonal feature C may include four-way stretch properties in at least one portion of the zonal feature C segment of the bra 82. In further aspects, the zonal feature C may include increased or decreased stretch properties or shaping features that are isolated within the zonal feature C based on stitch type, yarn density, or a combination of both stitch type and yarn density.

In seamless construction with zonal feature C, the zonal feature D portions of the bra 82 also provide varied stretch characteristics where stitch density and/or yarn type may be varied. In addition to altering stretch characteristics within the zonal feature D, which corresponds to a wearers bust cup region, the zonal feature D may include shaped features that are generated based on stitch and/or yarn type. For example, an increase knit stitch in the perimeter stitches of the zonal feature D may increase a shape of the cup region along a bottom edge of the zonal feature D. Additionally, a decrease knit stitch in the perimeter stitches of the zonal feature D may decrease the shape of the cup region along a top edge of the zonal feature D. As such, the flat-knit bra 82 may be engineered within the zonal feature D using flat-knit stitches providing shaping and a desired amount of stretch, while maintaining modesty in the cup region utilizing stitch and yarn properties.

As further shown in FIG. 4, the zonal feature E may include one or more different stitch types and/or yarn densities to generate a particular region between the bust cups of zonal feature D. In one example, the zonal feature E may include a series of dropped stitches and increase stitches to generate venting to provide air permeability of at least a portion of the bra 82. Additional aspects of the bra 82 include a zonal feature F along a front, bottom edge of the bra 82, having lockout and/or stretch characteristics corresponding to a desired flat-knit function of a portion of the bra 82. In one example, the stretch properties of the front zonal feature F may correspond to at least a portion of the stretch properties in the back zonal feature A. As such, in another aspect, the flat-knit bra may include a specific level of lockout in the zonal features B (straps) and F (band), while providing a specific level of stretch characteristic (e.g., 4-way stretch) to the zonal features A (back) and C (front).

In addition to changing yarns within various yarns of the bra 82, in some aspects, one or more yarns may be changed based on a specific color pattern or placement within the overall bra structure. For example, a flat-knitting method may be used to knit in a colored emblem, logo, branding indicator, and the like. As such, based on isolating yarns in the flat-knitting process between zones of the flat-knit bra, a particular colored yarn may be knitted in a particular location for a variety of visual effects, while at the same time, changing the structural and support aspects of the yarns being flat-knitted in unitary construction.

The exemplary zonal features A, B, C, D, E, and F in FIG. 4 are examples of one arrangement of stitches and/or yarns within a flat-knit bra. Although depicted with respect to zonal feature E, additional aspects of the bra 82 include venting structures knit into the garment body at various locations in the bra 82. Similarly, although lockout characteristics and stretch properties are discussed in aspects here with relation to particular bra portions, in further aspects, the varying lockout and stretch features within the bra may be adjusted to target a particular location or a particular characteristic of various bra structures. In one aspect, the various zonal features may be flat-knitted to provide wearer comfort, lightweight material characteristics, breathable features, lockout zones, specific stretch properties, or any combination of material features resulting from the flat-knit process in the unitary construction of the flat-knit bra.

Figure 5:
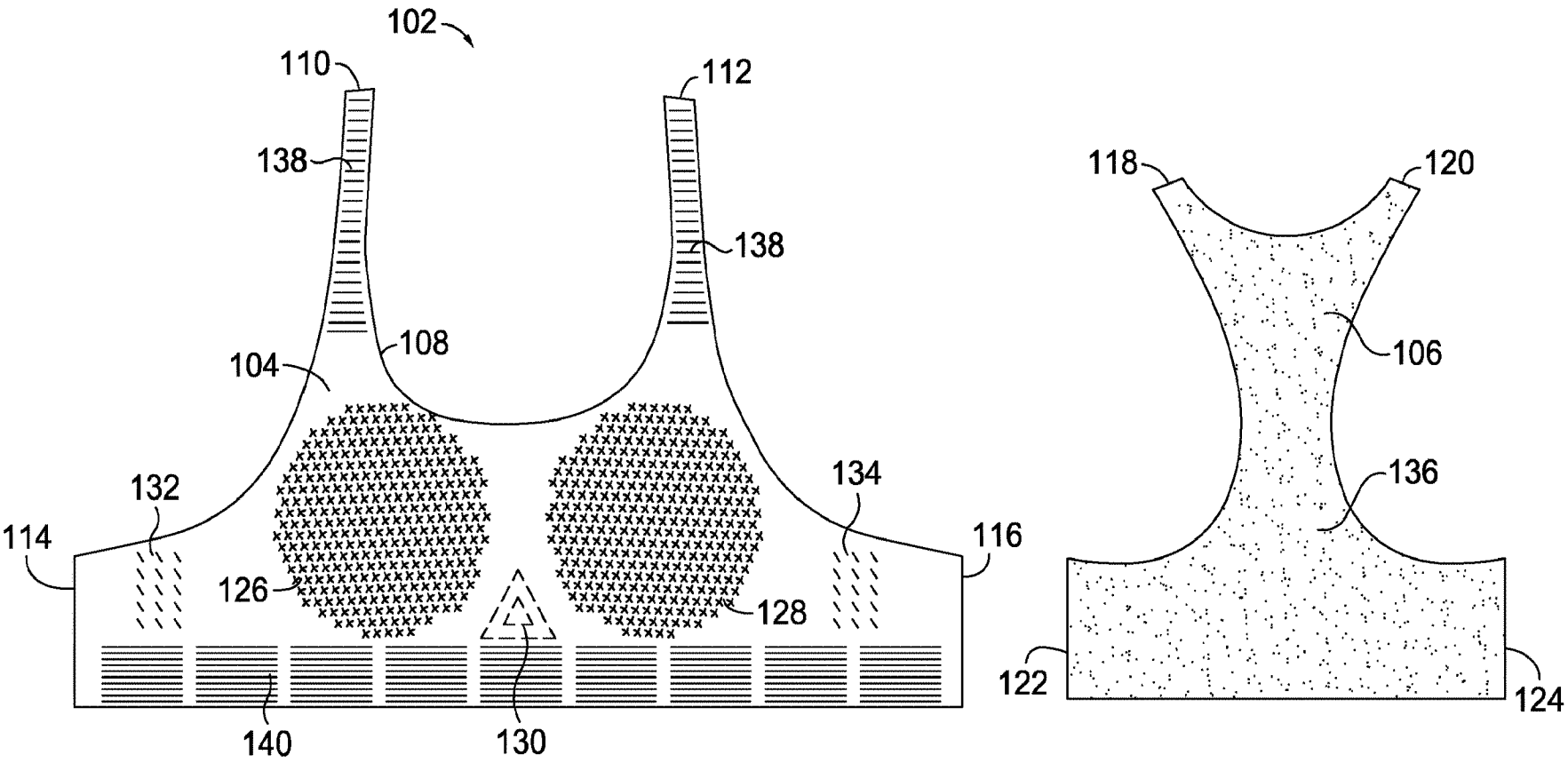
FIG. 5 depicts a top view of a flat-knit bra front and corresponding back portion, in accordance with various aspects.

With reference to FIG. 5, an exemplary flat-knit bra 102 includes a front portion 104 and a back portion 106 (e.g., a "racerback" portion). In aspects, one or both the front and back portions 104 and 106 may be flat-knitted to provide a bra structure free from surrounding textile structure. In other words, the front portion 104 and/or back portion 106 may be flat-knitted without requiring cutting out from a panel of surrounding material. In the example of FIG. 5, the front portion 104 includes a flat-knit edge 108, a left strap edge 110, a right strap edge 112, a left sewing edge 114, and a right sewing edge 116, which correspond to the upper left edge 118, upper right edge 120, left sewing edge 122, and right sewing edge 124 of the back portion 106. In some aspects, the front portion 104 includes a left bust cup region 126 and a right bust cup region 128, a middle region 130, a left wing region 132, a right wing region 134, a strap region 138, and a chest band region 140, while the back portion 106 includes a back region 136. In one aspect, a wing region may refer to an underarm portion or area near an armhole portion of a bra. In further aspects, the wing of the flat-knit bra, such as the left wing region 132 and the right wing region 134, may refer to any area between the bust cup regions and a back region of the bra in an as-worn configuration.

Additionally, the various regions throughout the front and back portions 104 and 106 may include one or more different bra region characteristics, such as stretch properties, lockout features, knit structures, yarn types, changes in stitch structure, changes in yarn type, increase zones, decrease zones, shaped zones, venting structures, or a combination of such bra region characteristic to provide a flat-knit bra 102 having specific breast support zones and additional bra features for flat-knitting without surrounding textile structure from which the bra must be removed.

In one aspect, the back portion 106 may include a breathable mesh material or other material that is separate from the flat-knitted construction of the bra front portion 104. In another aspect, a proportion and/or characteristic of one or more features of the flat-knit bra may be customized to provide a flat-knit bra that is configured to fit a variety of wearer's body shapes. For example, a single flat-knit bra front may include characteristics that correspond to both a first user being a first size and a second user being a second size that is different from the first size. As such, the customized wearability of the flat-knit bra may be engineered into one or more yarn features, zone features, structural features, functional aspects, bra front features, bra back features, or a combination of these various aspects of the flat-knit bra.

Figure 6:
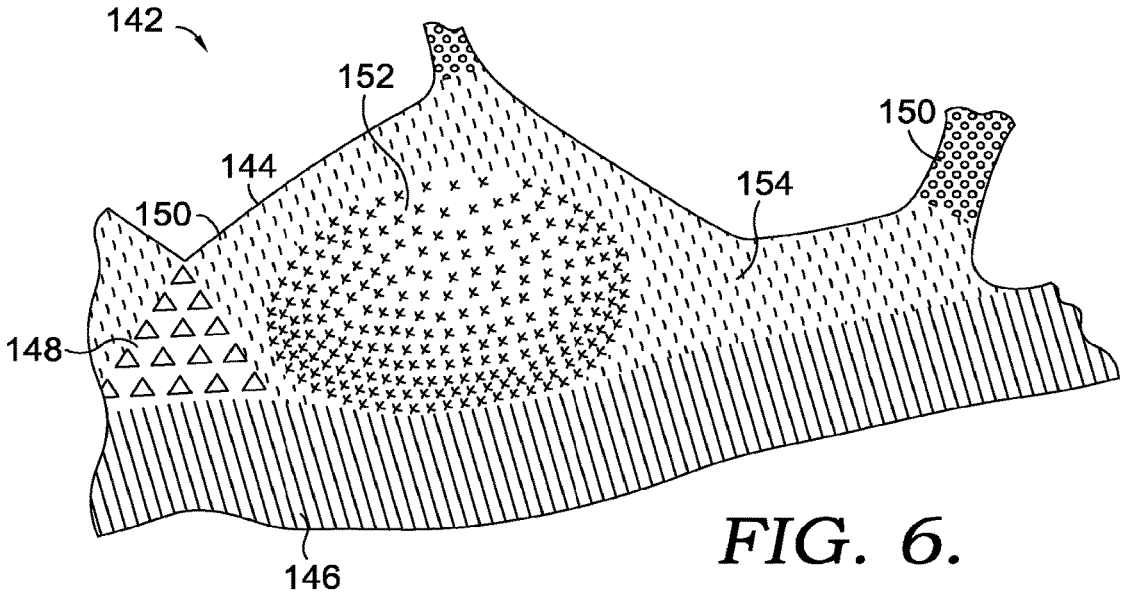
FIG. 6 depicts an enlarged view of a portion of a flat-knit bra having integrated flat-knit features in varying support zones of the bra, in accordance with various aspects.

With respect to specific features in specific zones and/or regions of the bra, as shown in the exemplary enlarged portion 142 of the flat-knit bra 150 of FIG. 6, integrated flat-knit features may be incorporated in varying support zones of the bra while maintaining a finished material with flat-knit edges 144, a unitary construction between the zones/regions, and a structure that is "knit to shape," in that it comes off of the flat-knitting machine with the desired structure and features. Additionally, while no surrounding textile material is cut away from the flat-knit edges 144, manufacturing waste is minimized and yarn material is conserved. During the flat-knitting process, the various stitch types may be used to create a first zone 146 corresponding to a chest band, a second zone 148 corresponding to a middle ventilation zone, a third zone 152 corresponding to a wearer's breast, and a fourth zone 154 corresponding to a wearer's underarm.

Figure 7:
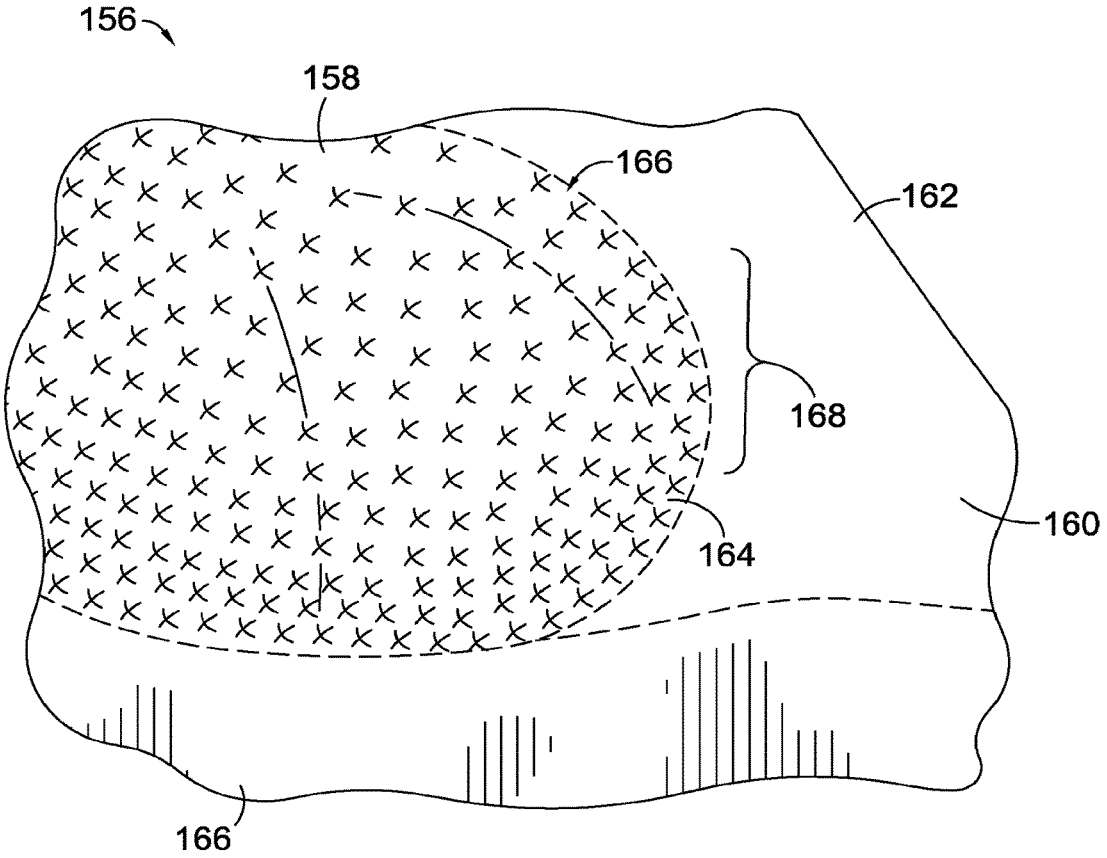
FIG. 7 depicts an enlarged, perspective view of a flat-knit bra having integrated flat-knit features providing shaping in accordance with various aspects.

In further aspects, as shown in FIG. 7, the exemplary enlarged portion 156 of a flat-knit bra 162 includes a bust cup zone 158 having particular stretch properties based on the particular stitches/yarns used within the bust cup zone 158, which vary the textile properties as contrasted with the adjacent bra body zone 160, and/or chest band zone 166. As such, the concentrated knit stitches 164 and the spaced knit stitches 166 may be used to create a shaped zone 168 as part of the bust cup zone 158. In one aspect, one or more areas of the flat-knit bra may include a knitted-in channel for cushioning, such as a channel large enough to accommodate a cup pad or cup lining, either removable or nonremovable, that corresponds to at least a portion of the cup zone 158. For example, the flat-knit bra may include a flat-knit cup channel and/or pocket that is flat-knitted with the surrounding bra body to receive a cup pad and/or cup liner.

In one aspect, a bra body such as the bra body zone 160 may refer to any portion of the flat-knit bra providing a common foundation. For example, the bra body may include any portion of the flat-knit bra for coupling one or more zones. In another example, the flat-knit bra body may include a supporting feature other than the straps, cups, chest band, and/or wings. In yet another example, the bra body may include a particular stretch property or zonal structure to generate overall support to the circumference of the wearer's torso. As such, the bra body may refer to an area between two bra cups, an area between bra cups and bra straps, an area between bra cups and bra wings, and an area between bra wings and a bra back.

Figure 8:
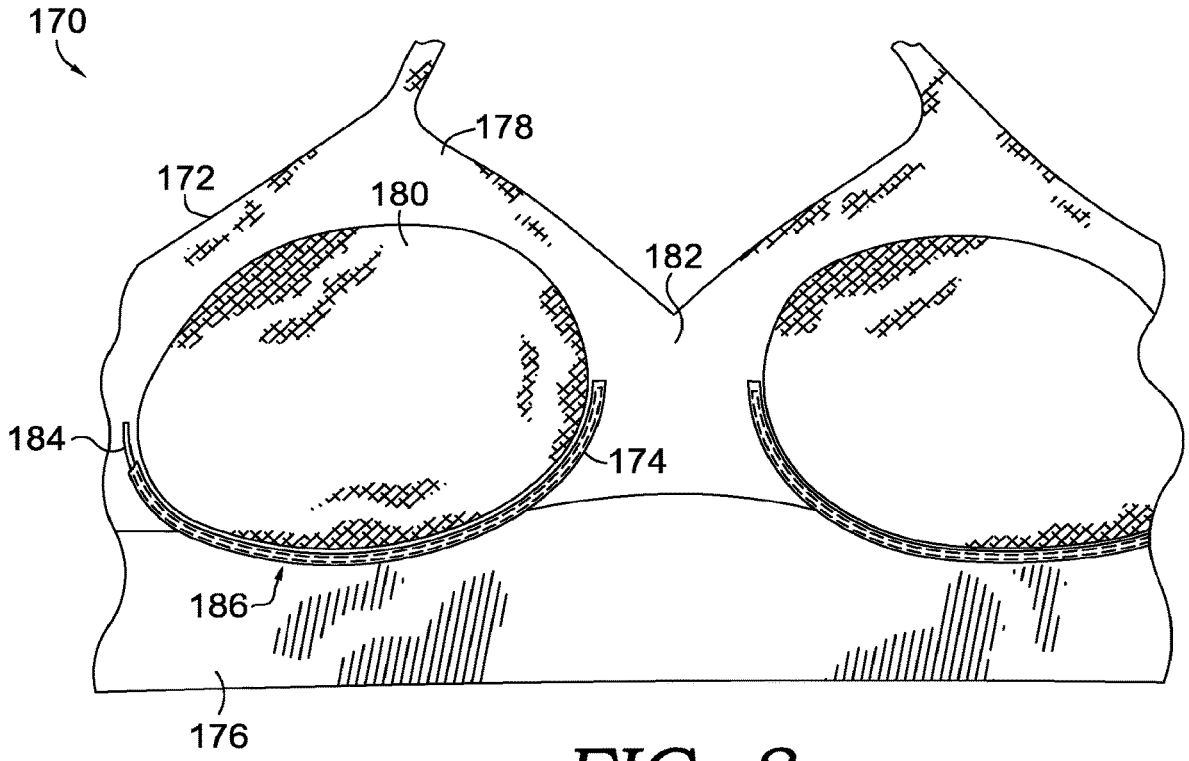
FIG. 8 depicts a front, perspective view of a flat-knit bra having integrated support structures, in accordance with various aspects.

Turning next to FIG. 8, the exemplary bra body 172 of the flat-knit bra 170 includes integrated support structures 174 in seamless construction with the surrounding flat-knit chest band 176, flat-knit edge/neckline 178, cup 180, and bra center 182. In one example, the integrated support structure 174 may provide a channel for receiving a cable 184 and/or feeder structure for guiding in a cable or other structure. Such integrated support structure 174 channel may be flat-knitted for including one or more additional support structures in the bra body 172. For example, the cable 184 may include a cable and/or cord inside the integrated support structure 174 for providing stationary and/or adjustable support to the bra cup 180. As such, one or more support structures associated with the integrated support structure 174 may be used to provide additional lift to the underside 186 of the cup 180. In another aspect, the integrated support structure 174 may be flat-knitted into different positions within the flat-knit bra, such as an integrated support structure in the strap portion of the bra. Additionally, the integrated support structure 174 may be flat-knitted at the same time that the cable 184 is knitted into the tunnel and/or opening. In further aspects, the integrated support structure 174 and/or cable 184 may be utilized to provide an adjustment system for the flat-knit bra, such as via the insertion of functional cables, stationary or moveable cables, adjustable cables, and the like. As such, the integrated support structure 174 and/or cable 184 may be tacked down in a particular location after being knitted into the material of the flat-knit bra. In one aspect, the cable 184 structure may be pulled up and tightened to provide particular support in a particular zone of the flat-knit bra. Further, a yarn having a particular characteristic (e.g., rigidity or structure different from the surrounding yarns) may be knitted in the flat-knit bra without having to insert it separately and bulk up the material of the bra.

Figure 9:
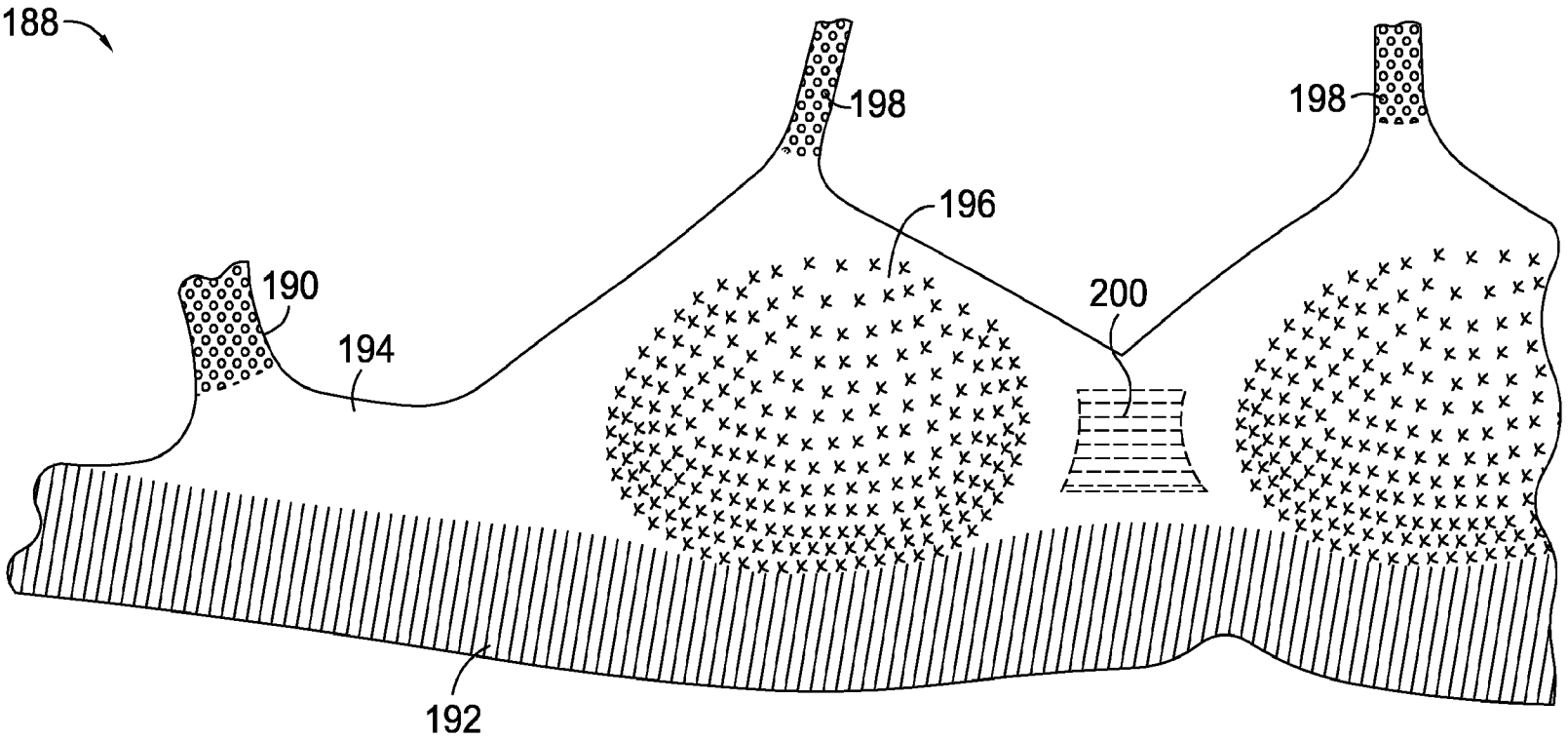
FIG. 9 depicts a front, perspective view of isolated support zones within the flat-knit bra based at least in part on changing yarns, in accordance with various aspects.

In the exemplary flat-knit bra 188 of FIG. 9, various isolated zones are generated within bra 188 based on changing yarns and/or knit stitches. For example, a first yarn having a first stretch property may be used in zone 190, a second yarn with a second stretch property may be used in zone 192, a third yarn having a third stretch property may be used in zone 194, a fourth yarn having a fourth stretch property may be used in zone 196, a fifth yarn having a fifth stretch property may be used in zone 198, and a sixth yarn having a sixth stretch property may be used in zone 200. In some aspects, the various zones within the flat-knit bra 188 may include similar, the same, or different stretch properties depending on a desired stretch characteristic, bra location, or zonal placement. For example, a yarn and/or stitch type on an outer edge of a particular zone may be changed to provide a particular structural characteristic in relation to the adjacent, flat-knit bra structure.

Figure 10:
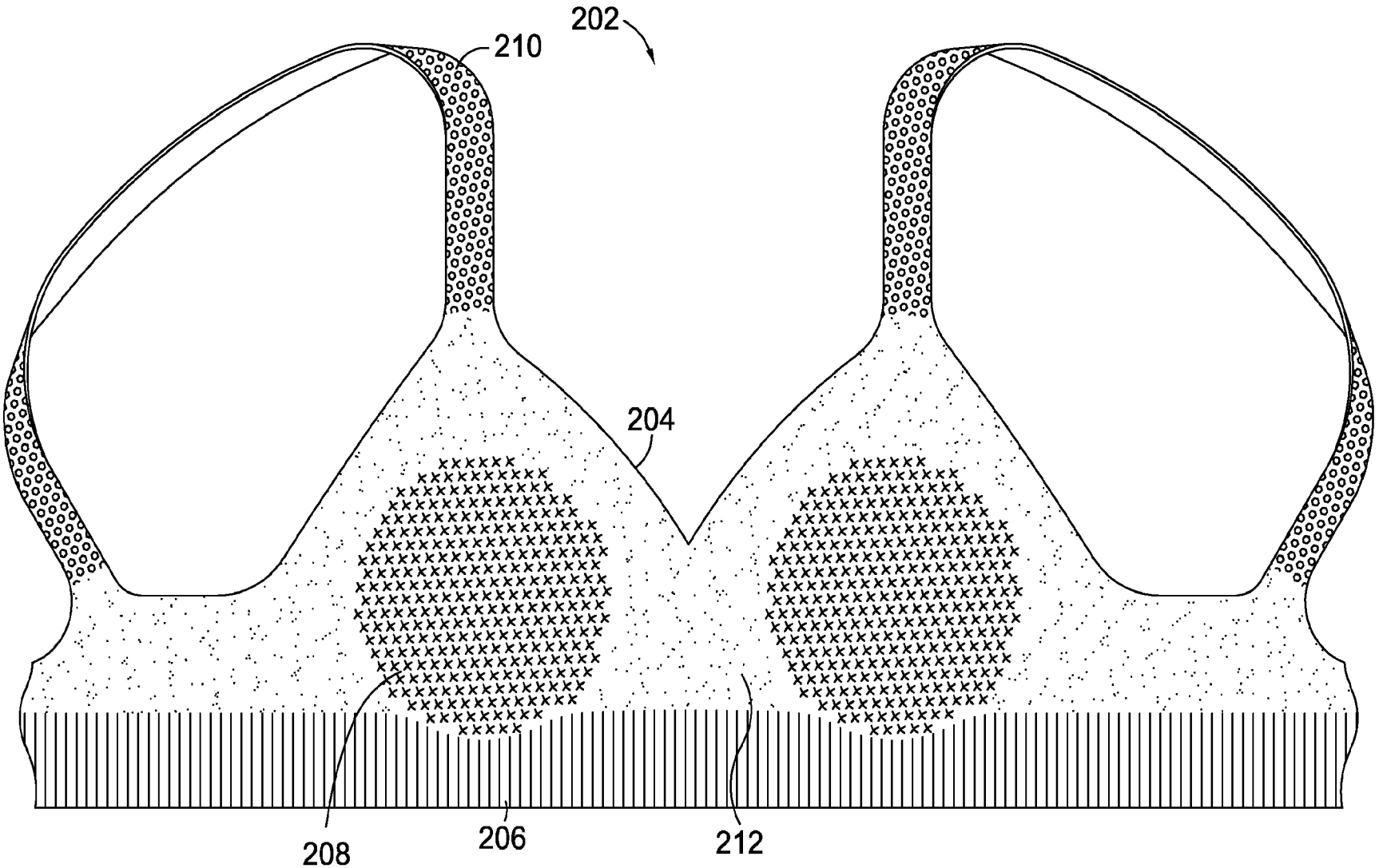
FIG. 10 depicts a front view of a flat-knit bra having a unitary knit structure including unitary flat-knit straps, in accordance with various aspects.
Figure 11:
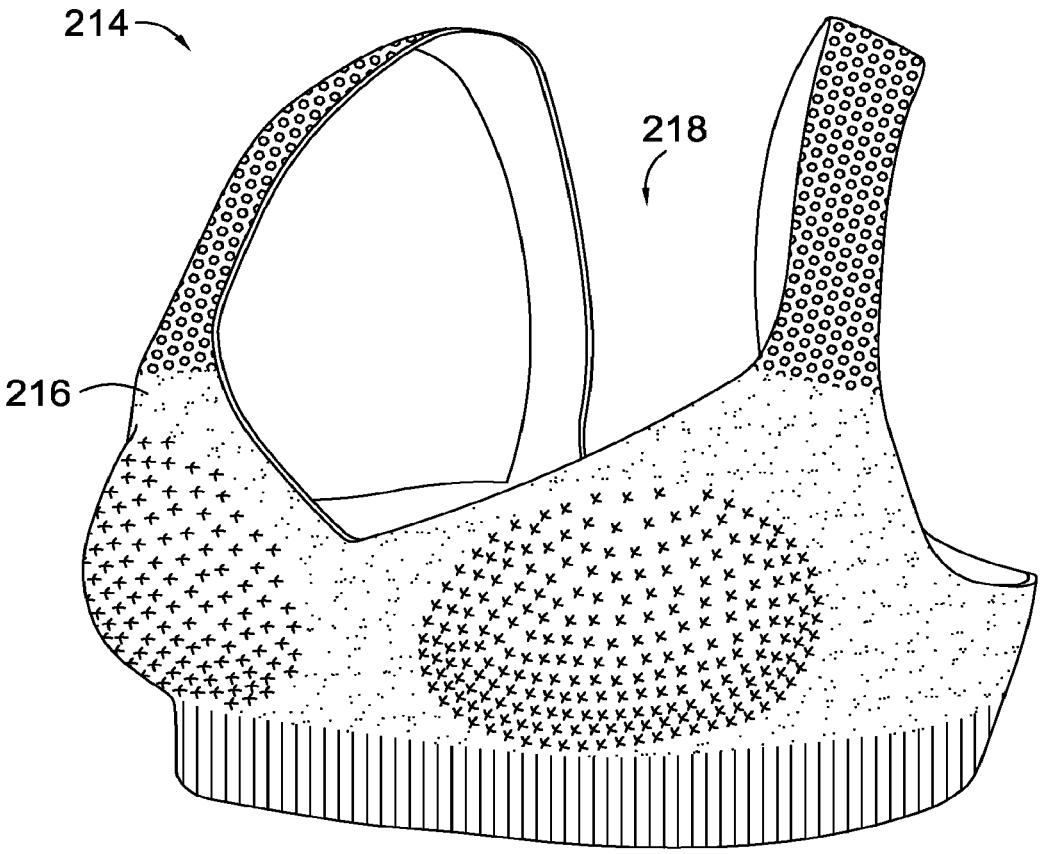
FIG. 11 depicts a front, perspective view of an assembled, flat-knit bra, in accordance with various aspects.

In the exemplary embodiment of FIG. 10, a flat-knit bra 202 may include flat-knit edges 204 surrounding the first zone 206, second zone 208, third zone 210, and fourth zone 212. In this example, the third zone 210 may include entire straps or strap portions that form the flat-knit straps of the bra 202. As such, the third zone 210 may include continual, flat-knit features that are assembled with the common flat-knit edge 204. Alternatively, the flat-knit straps of the third zone 210 may be knitted in an unattached configuration in at least one location, for later sewing during final assembly. Accordingly, with reference to FIG. 11, flat-knit bra 214 includes a unitary bra structure 216 having at least one seam on a back side of the bra 218. In this example, the bra body may be joined together along the bound-off, flat-knit edges of the bra body, without requiring removal of surrounding material. In some aspects, additional manipulation of the flat-knit bra 214 may include steaming, molding, blocking, and/or shaping of one or more portions of the bra, such as the breast cups having dimension with respect to the surrounding bra structure 216. In another aspect, the flat-knit bra 214 may be treated with one or more additional processing steps, such as a heat-treated fusing of yarns or a coloring application applied to the flat-knit surface.

In further aspects, the flat-knit bra 214 may be flat-knit in a fully fashioned manner, providing all of the structural features functional zones for providing support and stretch characteristics of a finished bra. In further aspects, the flat-knit bra 214 may be provided with a flat-knit front portion and a separately attached back panel. In this example, the back panel may be flat-knit, or may be a separate material made from a variety of fabrics or construction methods. Additionally, a flat-knit bra front may be engineered to facilitate additional portions coupled to the flat-knit bra, such as an additional cup insert or lining feature coupled to the flat-knit bra base once the bra base is flat-knitted with flat-knit-edges. The flat-knit bra may also be generated with flat-knit edges that may be coupled to additional features, such as a separate chest band, label insert, and the like. Although fully knitted in a flat-knit form, additional treatments may also be applied to the finished, flat-knit bra, such as a heat treatment applied to a particular portion of the bra during molding or locking out, an ironing on of a heat-transfer label or other identifying information, or attachment of a separate embroidered, knitted, or woven feature.

In one aspect, an additional layer for support, comfort, or wearability may be added to or incorporated with the flat-knit bra structure, such as a separate bra lining material coupled to the flat-knit bra front. As such, while the flat-knit bra front may have a resulting material surface generated from various zones, yarns, stitches, structures, dimension, and the like, the internal surface of the flat-knit bra front may be coupled to a separate liner treatment to generate a smoother surface as compared to the internal surface of the flat-knit bra front. In another embodiment, during flat-knitting, a smoother-surface bra lining may be knitted separate from but adjacent to the flat-knit bra front. As such, the unitary construction of the bra may be maintained while a first orientation of yarn flat-knits the bra front, and a second orientation of yarn flat-knits the lining that is worn next to the skin of a wearer. It is contemplated that numerous aspects of the flat-knit bra, including the flat-knit bra front having a first layer of flat-knit zonal structure and a second layer of smoother-structure for skin contact, may utilize one or more different knitting techniques, including flat-knitting of the unitary bra structure.

Additional aspects of a flat-knitted support garment are described with respect to FIGS. 12-16, where various flat-knit bra materials are shown in unassembled configurations. Initially, FIG. 12 includes an exemplary flat-knit support garment 220 in a bra 222 configuration for supporting a wearer's breasts. As will be understood, while shown here in a bra 222 configuration, one or more features of the flat-knit support garment 220 may be incorporated into additional support garment configurations for an upper torso, such as a camisole, bodysuit, base layer, shirt liner, or other support garment including the flat-knit features of the bra 222. The exemplary bra 222 includes a flat-knit material 224 having a variety of integral flat-knit zones throughout, such as the cup zone 226, body zone 228, wing zone 230, back zone 232, chestband zone 234, strap zone 236, and transitional zone 238. The transitional zone 238 may include the same flat-knit material 224 as that within either the strap zone 236 or the back zone 232. Alternatively, the transitional zone 238 may include one or more changes in flat-knit material 224 as compared to the adjacent back zone 232 and/or strap zone 236, such as, for example, a portion of flat-knit material 224 having the same configuration as wing zone 230 and/or body zone 228.

In some aspects, each zone includes at least one characteristic that differs from at least one adjacent, flat-knit zone, such as a yarn type and/or stitch sequence. Accordingly, the flat-knit cup zone 226 may include a first stitch sequence, while the adjacent body zone may include at least a portion of a second stitch sequence. Similarly, the flat-knit body zone 228 may include a first yarn type while the adjacent, flat-knit strap zone 236 may include at least one yarn type different than the flat-knit body zone 228 yarn type. Each flat-knit zone within the seamless, flat-knit material may therefore include yarn and stitch variations that alter the stretch characteristics and resulting modulus of different portions of the support garment 220. For example, the cup zone 226 of the bra 222 may include a low stretch modulus, the body zone 228 may include a lower stretch modulus (relative to the cup zone 226 low stretch), while the back zone 232 provides a high stretch modulus zone. The strap zone 236 may include a no-stretch zone (i.e., lockout zone), with a medium stretch transitional zone 238 between the no-stretch strap zone 236 and the high stretch back zone 232.

The finished neckline edge 240 and the finished armhole edge 242 is integral to the flat-knit construction of the bra 222, as each of the neckline edge 240 and the armhole edge 242 include flat-knitted material 224 generated without seaming or finishing, and instead is supportive of the unitary knitted structure within the support garment 220. Such finished-edge structure of both the neckline edge 240 and the armhole edge 242 is maintained via boundary changes between support zones of the bra 222, in seamless, flat-knit construction. A first seamless boundary 250 between cup zone 226 and body zone 228 may be achieved via flat knitting by maintaining at least one common yarn between the cup zone 226 and the body zone 228. In other aspects, a first seamless boundary 250 between cup zone 226 and body zone 228 is achieved via flat knitting by at least one common knit stitch between the cup zone 226 and the body zone 228. In some aspects, the seamless boundary between adjacent, flat-knit zones may provide an intermediate zone, having its own stitch configuration and including portions of both of the adjacent stitch configurations to provide an intermediate zone.

Similar boundaries may be present between additional, adjacent zones of the flat-knit support garment 220, such as the second seamless boundary 252 between the bra body 228 and the wing zone 230, the third seamless boundary 254 between the wing zone 230 and the back zone 232, and a fourth seamless boundary 258 between portions of the body zone 228, portions of the wing zone 230, and portions of the back zone 232, all with respect to the chestband zone 234. Continuing in an upward direction along the y axis, such as in a knitting direction of the flat-knit material 224, additional seamless boundaries may include the fifth seamless boundary 256 between the strap zone 236 and the bra body 228 and/or transitional zone 238.

Having flat-knitted multiple flat-knit zones created in seamless construction with each adjacent zone, a first seam edge 244 may be configured to join to the second seam edge 246, while the third seam sedge 248 may be configured to join to the fourth seam edge 250. In some aspects, a molding region 260 within the flat-knit material 224 includes a first cup molding region 262 and a second cup molding region 264, with one or more flat-knit features proximate the first seamless boundary 250, surrounding each of the first cup molding region 262 and the second cup molding region 264, that facilitate molding of each bra 222 cup. As will be discussed in greater detail below with respect to molded support garments 220, a transitional flat-knit structure along and/or proximate to the seamless boundary 250 surrounding each flat-knit cup zone 226 may stabilize the surrounding flat-knit material 224 during molding or other finishing treatment within the molding region 260.

Figure 12:
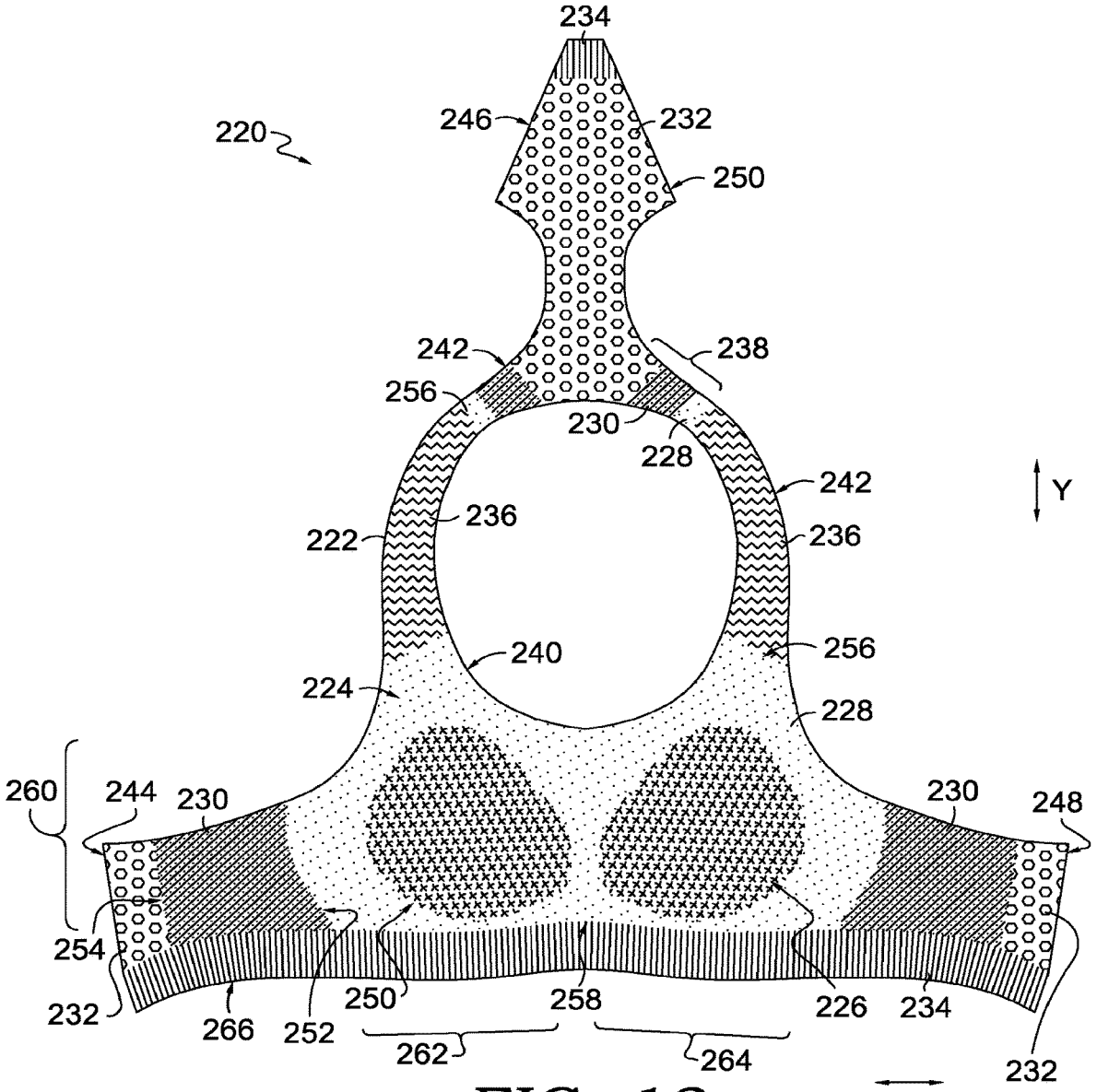
FIG. 12 depicts a top view of a flat-knit bra in an unassembled configuration, in accordance with various aspects.

As further depicted in FIG. 12, an apparel boundary 266 is indicated with respect to a lower edge of the bra 222. As such, the bra 222 may be flat-knit, integral with a surrounding material for an upper torso garment, such as a camisole. In some instances, the apparel boundary 266 may be proximate the armhole edge 242, neckline edge 240, and/or chestband zone 234, providing a support garment 220 that is integral to additional support features of upper torso garments, such as a base layer garment having a built-in, flat-knit bra 222.

Figure 13:
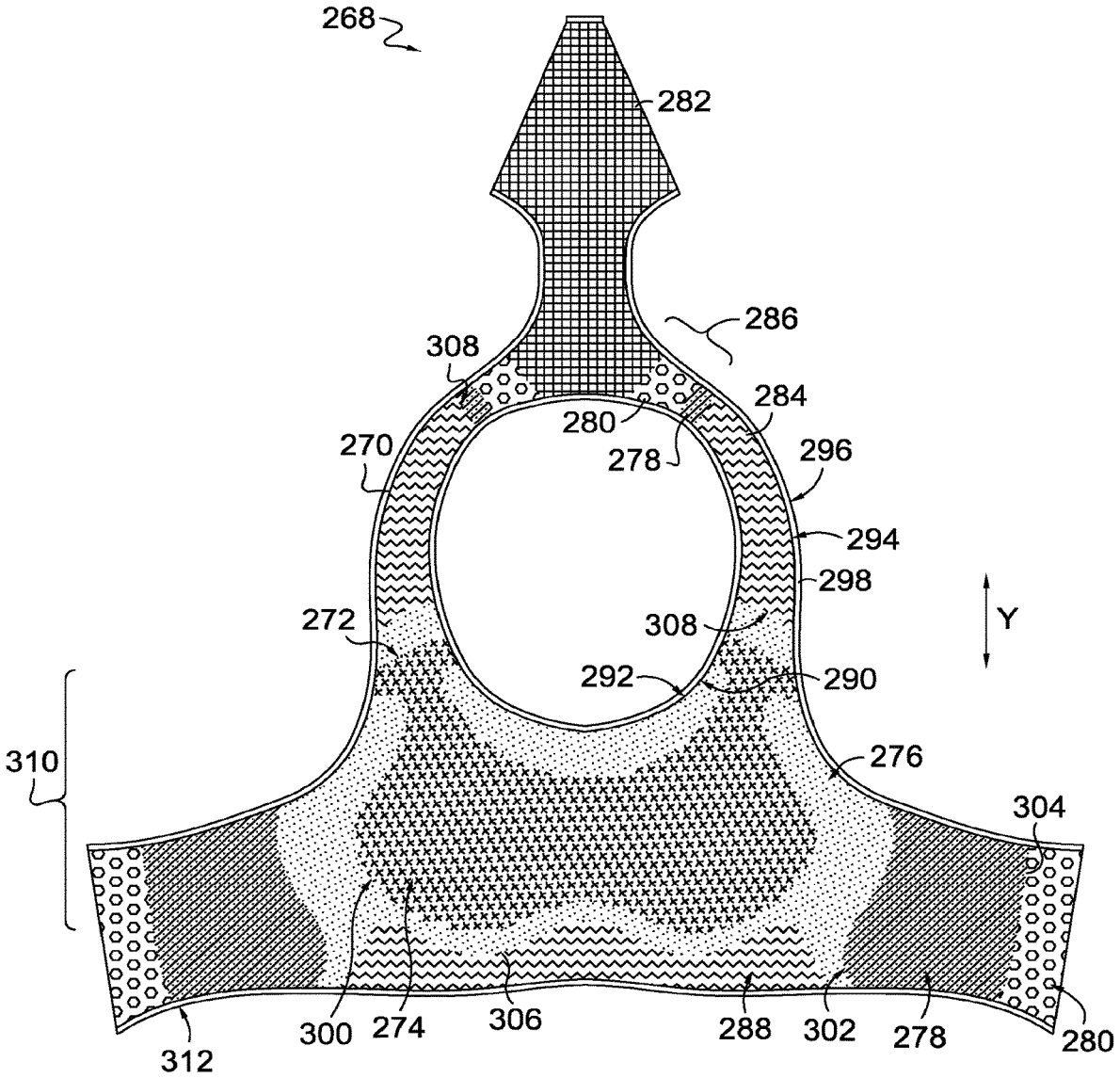
FIG. 13 depicts a top view of a flat-knit bra in an unassembled configuration, in accordance with various aspects.

Turning next to FIG. 13, another exemplary flat-knit support garment 268 for a bra 270 includes a seamless, flat-knit material 272 having a variety of integral flat-knit zones throughout, such as the cup zone 274, body zone 276, wing zone 278 first back zone 280, second back zone 282, strap zone 284, transitional zone 286, and bust-support zone 288. The transitional zone 286 may include the same flat-knit material 272 as that within one or both of the second back zone 282 and the strap zone 284. Alternatively, the transitional zone 286 may include one or more features of the flat-knit material 272 as within the wing zone 278 and/or the first back zone 280.

In some aspects, each zone includes at least one characteristic that differs from at least one adjacent, flat-knit zone, such as a yarn type and/or stitch sequence. Such variation within the flat-knit support garment 268 changes an amount of support provided to a wearer based on each zone of the bra 270, a modulus of stretch within each zone of the flat-knit bra for both function during wear and ease of pulling on and off over a wearer's head. Accordingly, the flat-knit cup zone 274 may include a first stitch sequence, while the adjacent body zone 276 may include at least a portion of a second stitch sequence. Similarly, the flat-knit body zone 276 may include a first yarn type while the adjacent, flat-knit strap zone 284 may include at least one yarn type different than the flat-knit body zone 276 yarn type. Each flat-knit zone within the seamless, flat-knit material 272 may therefore include yarn and stitch variations that alter the stretch characteristics and resulting modulus of different portions of the support garment 268. For example, the cup zone 274 of the bra 270 may include a medium stretch modulus, the body zone 276 may include a low stretch modulus (relative to the cup zone 226 medium stretch), the wing zone 278 may include a lower stretch modulus (relative to the body zone 276 low stretch), the strap zone 284 and the bust-support zone 288 may include a no-stretch modulus (i.e., lockout), while the first back zone 280 provides a medium stretch modulus and the second back zone 282 provides a high stretch modulus zone. The transitional zone 286 may exhibit one or more stretch characteristics, such as a low stretch modulus adjacent the second back zone 282, and a medium stretch modulus adjacent the strap zone 284.

In some aspects, one or more yarns are flat-knitted within each zone of the flat-knit support garment 268. In some instances, a multi-component yarn may be optimized for use within each zone, or multiple zones, of the flat-knit bra, with the corresponding changes in bra support associated with stitch sequence, partial knitting, in-laid yarns, and other integrated structures of the flat-knit material. One yarn flat-knitted throughout one or more zones of the bra may include a primary yarn material covered or not covered by a secondary yarn. For example, a yarn flat-knitted through one or more zones of the bra may include a nylon and/or texturized polyester yarn covering a Spandex yarn, with a resulting denier, a particular filament size, and final ply. For example, a base yarn for the flat-knit bra may include a polyester and/or nylon yarn wrapped around a Spandex yarn. For example, a 40-50 denier PET and a 40-50 denier Nylon may be used to cover a 70-80 denier Spandex. In further aspects, a 42-46 dtex PET and a 42-46 dtex Nylon may be covered by a 75-81 dtex Spandex. As such, the polyester and Nylon yarns may be used to cover (i.e., wrap around) the Spandex yarn, according to some aspects.

In one example, the covered yarn may be used in one or more zones of the flat-knit support garment. In further examples the covered yarn may be used in all zones of the flat-knit support garment, with variations in stitch sequence, support structures, in-laid yarns, and other integrated features providing the changing supportive functions across a garment having a primary yarn content. In other aspects, at least a portion of the support garment 268 may include non-covered yarn, while adjacent portions of the support garment 268 may include covered yarn. Because of the unitary, flat-knit structure of the flat-knit support garment 268, such changes between covered and non-covered yarn may take place in seamless construction across knitted zones of the bra, within knitted zones of the bra, and within organic, zonal placement at various zones of the bra. For example, an uncovered stretch edge along a perimeter of the flat-knit support garment, such as the stretch zone 298, may include a Spandex yarn suitable for contact with a wearer's skin and configured to ease on-and-off wear of the support garment. Such stretch edge having an un-covered Spandex yarn with softer feel, may seamlessly transition to the flat-knit body of the bra, changing from uncovered yarn to covered yarn where the stretch edge transitions to adjacent covered zone, such as the stretch edge transitioning to the wing zone 278, body zone 276, strap zone 284, and back zone 280, for example.

In addition to changing a material feel between the stretch-edge uncovered yarn and the main portions of the support garment having covered yarn, one or more changes in yarn content and/or stitch sequence may be used to generate a resulting material property, such as a lockout characteristic in a particular zone of the bra. For example, a strap zone having lockout characteristics may include specific, harder yarn in place of or in addition to the covered yarn of the support garment. In further aspects, yarn content changes throughout the flat-knit support garment may correspond to one or more of the zones depicted in each example. While shown in these examples as having a particular graphic element, each zone within the flat-knit support structure may carry a common yarn color, thereby disguising a change between adjacent zones utilizing the same color of yarn, but different stitch sequences.

Further adjustments to the yarn content of the flat-knit support garment 268 may include changes associated with the weight of the yarn, thickness of the material achieved using the particular yarns of each zone, yarn selection corresponding to performance characteristics of the resulting support garment, and other yarn optimizations desired to generate integrated features of the flat-knit support garment. As an example of one such yarn selection, aspects of a flat-knit support garment yarn may include a 30-55 denier yarn. In other aspects, the yarn flat-knitted in various zones of the support garment include a 40-50 denier yarn, while in other aspects, an approximately 44-denier yarn may be flat-knitted in one or more zones of the flat-knit support garment. Accordingly, a particular denier yarn may be knitted within various portions of the flat-knit bra, based on a desired yarn size for each portion of the bra, and according to the machine gauge and desired stitches per inch of the resulting flat-knit material.

With continued reference to FIG. 13, the boundaries between adjacent flat-knit zones of the bra 270 may include a first seamless boundary 300, a second seamless boundary 302, a third seamless boundary 304, a fourth seamless boundary 306, and a fifth seamless boundary 308. As discussed above with respect to FIG. 12, such seamless boundaries are indicated within the flat-knit material 272 as including a change in at least one flat-knit stitch sequence and/or flat-knit yarn type, while maintaining a unitary bra material 272.

The finished neckline edge 290 and the finished armhole edge 294 are integral to the flat-knit construction of the bra 270, without additional knitted structure, edging, seaming, or finishing, and instead is supportive of the unitary knitted structure within the support garment 268. However, in some aspects, the support garment 268 includes a high-power stretch zone 298 that borders one or both of the neckline edge 290 and the armhole edge 294. For example, a first yarn may form the unitary structure of the bra material 272, while a second yarn may form the high-power stretch zone 298 that generates an armhole stretch edge 296 and/or neckline stretch edge 292. Aspects of the bra 270 include a first yarn type throughout the bra material 272 and a second yarn type throughout the high-power stretch zone 298.

In some aspects, a molding region 310 within the flat-knit material 272 includes a transitional flat-knit structure along and/or proximate to the first seamless boundary 300 surrounding the flat-knit cup zone 274 that stabilizes the surrounding flat-knit material 272 during molding or other finishing treatment within the molding region 310. Further, the apparel boundary 312 depicted near the bottom edge of the bra 270 may be may be flat-knit, integral with a surrounding material for an upper torso garment, such as a camisole. In some instances, the apparel boundary 312 may be proximate the armhole stretch edge 296, the bra material armhole 294, the neckline stretch edge 292, with such apparel boundary 312 being integral to additional support features of upper torso garments, such as a base layer garment having a built-in flat-knit bra 270.

Figure 14:
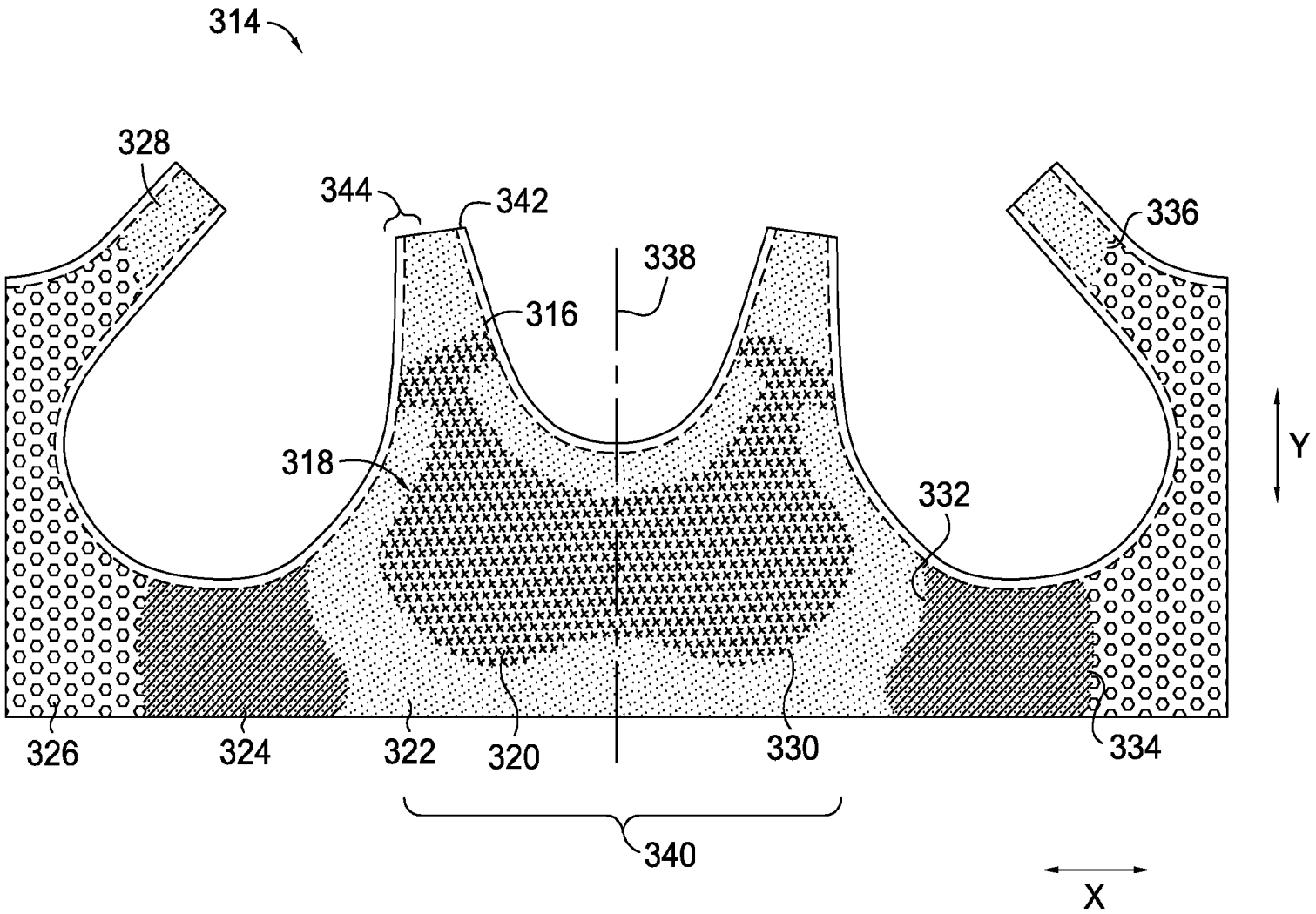
FIG. 14 depicts a top view of a flat-knit bra with a stretch edge along at least a portion of the perimeter of the flat-knit bra, in an unassembled configuration, in accordance with various aspects.

In FIG. 14, a top view of an exemplary support garment 314 for a flat-knit bra 316 includes a flat-knit, seamless bra material 318 with a cup zone 320, a body zone 322, a wing zone 324, a back zone 326, a strap zone 328, a first boundary 330, a second boundary 332, a third boundary 334, and a fourth boundary 336, displayed with reference to the boundary of symmetry 338. The molding region 340 of the bra 316 includes an organic-shaped first boundary 330 surrounding the cup zone 320. Such organic-shaped first boundary 330 corresponds to a mold size for at least one finishing treatment of the bra material 318, and may include at least one flat-knit feature proximate the organic, first boundary 330 that facilitates molding within the molding region 340. Whether corresponding to a molding region 340, or other finishing process applied to the bra material 318, aspects of the bra 316 include both linear boundaries, such as the fourth boundary 336, as well as organic boundaries, such as the second boundary 332. In some instances, the various boundaries within the bra 316, corresponding to transitions between specific zones of the bra, may be graduated transitions between stitch sequences. For example, a fourth boundary 336 may include a gradual transition from the stitch sequence in the strap zone, to a stitch sequence of the back zone.

Based on the desired performance of the bra 316 once finished, the support garment 314 may include a particular position of a seamless boundary between adjacent flat-knit zones having various stretch properties, such as a particular flat-knit boundary characteristic between a high-stretch and a low-stretch zone. Such integral boundary and/or transitional zones may provide further optimization of the functional cup zone 320, body zone 322, wing zone 324, back zone 326, and/or strap zone 328. As discussed above, such transitional boundaries between two different flat-knit zones of the bra may facilitate molding of at least a portion of the bra. For example, the first boundary 330 between the cup zone 320 and the body zone 322 may provide shaping structures at or near the cup zone 320 that result in a pre-shaped and/or pre-molded flat-knit bra material. Further, the pre-shaped cup zone 320, such as a flat-knit cup zone with short rows and/or partial knitting proximate the first boundary 330, may be molded with a shallower mold and/or cooler mold treatment to alter the configuration of the cup zone 320 and preserve the surrounding body zone 322.

Figure 15:
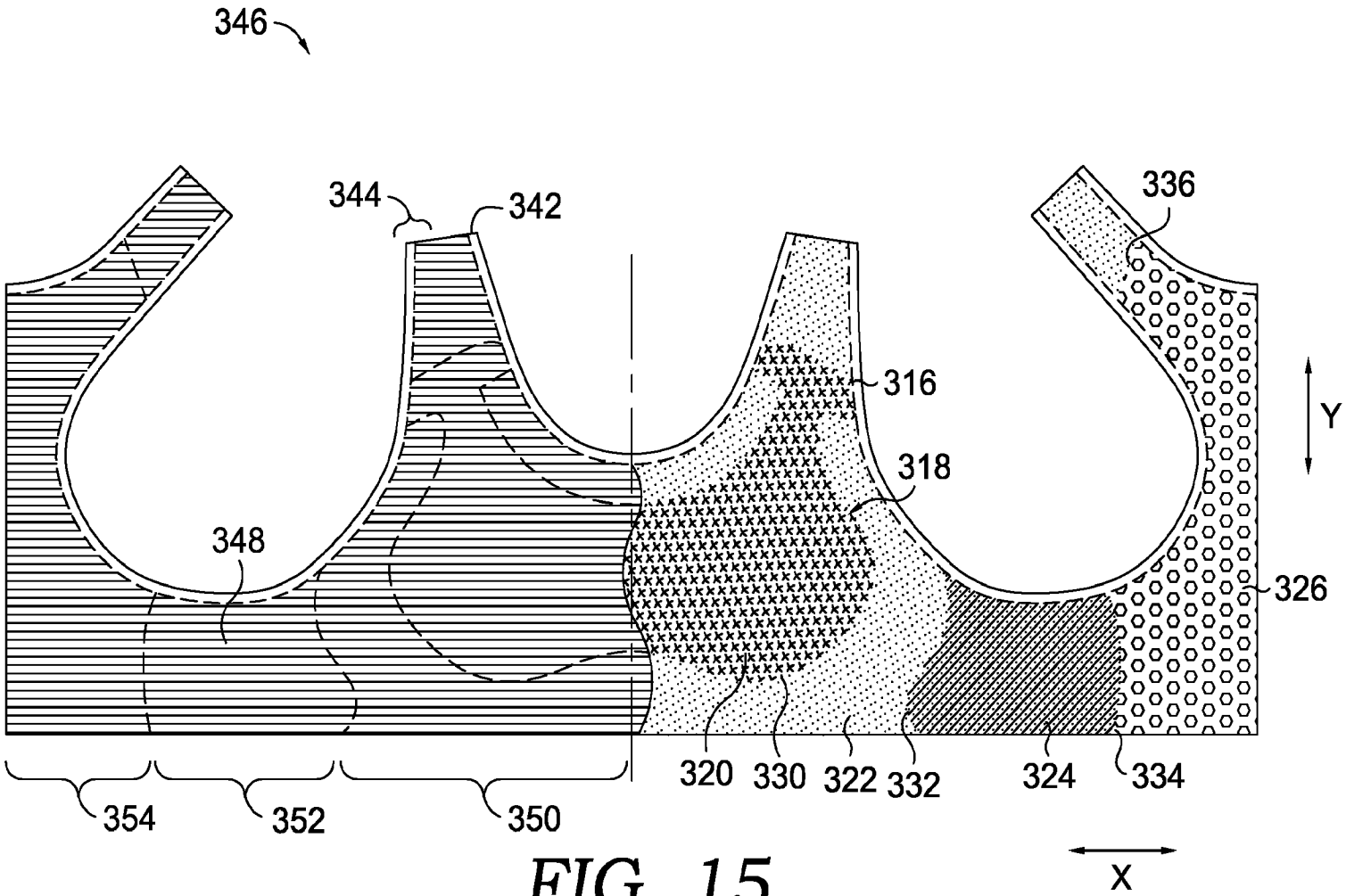
FIG. 15 depicts a top view of the flat-knit bra of FIG. 14, with an integral patterning feature cut away from a portion of the bra, in accordance with various aspects.

As shown in the support garment 346 of FIG. 15, an integral patterning feature 348 may be incorporated with the bra 316, and is depicted in a cut-away view from the bra material 318. The integral pattern feature 348 may include one or more flat-knit structures that is knit adjacent to or integral with the bra material 318. As such, at least one needle may be utilized adjacent the flat-knitting needles generating the bra material 318, providing a visual change in material associated with the patterning feature 348. In some aspects, the integral patterning feature 348 may include any variety of flat-knit stitch sequences, yarn changes, and/or knitting techniques that correspond to the cup zone 320, body zone 322, wing zone 324, back zone 326, and/or strap zone 328. For example, the integral patterning feature 348 may include a first pattern zone 350 corresponding to the cup zone 320 and body zone 322, a second pattern zone 352 corresponding to the wing zone 324, and a third pattern zone 354 corresponding to the back zone 326. Without generating a separate layer of flat-knit material, in some aspects, the integral patterning feature 348 may utilize a common needle bed with different yarn feeders than those knitted within the bra material 318. In further aspects, the patterning feature may be a second material layer coupled to the bra 316. As shown in the example of FIG. 15, a common stretch edge 342 having a consistent edge width 344 may surround a perimeter of the support garment 346, further facilitating any number of yarn and/or stitch combinations within the bra 316 that seamlessly transition to an outer, flat-knit stretch edge.

Figure 16:
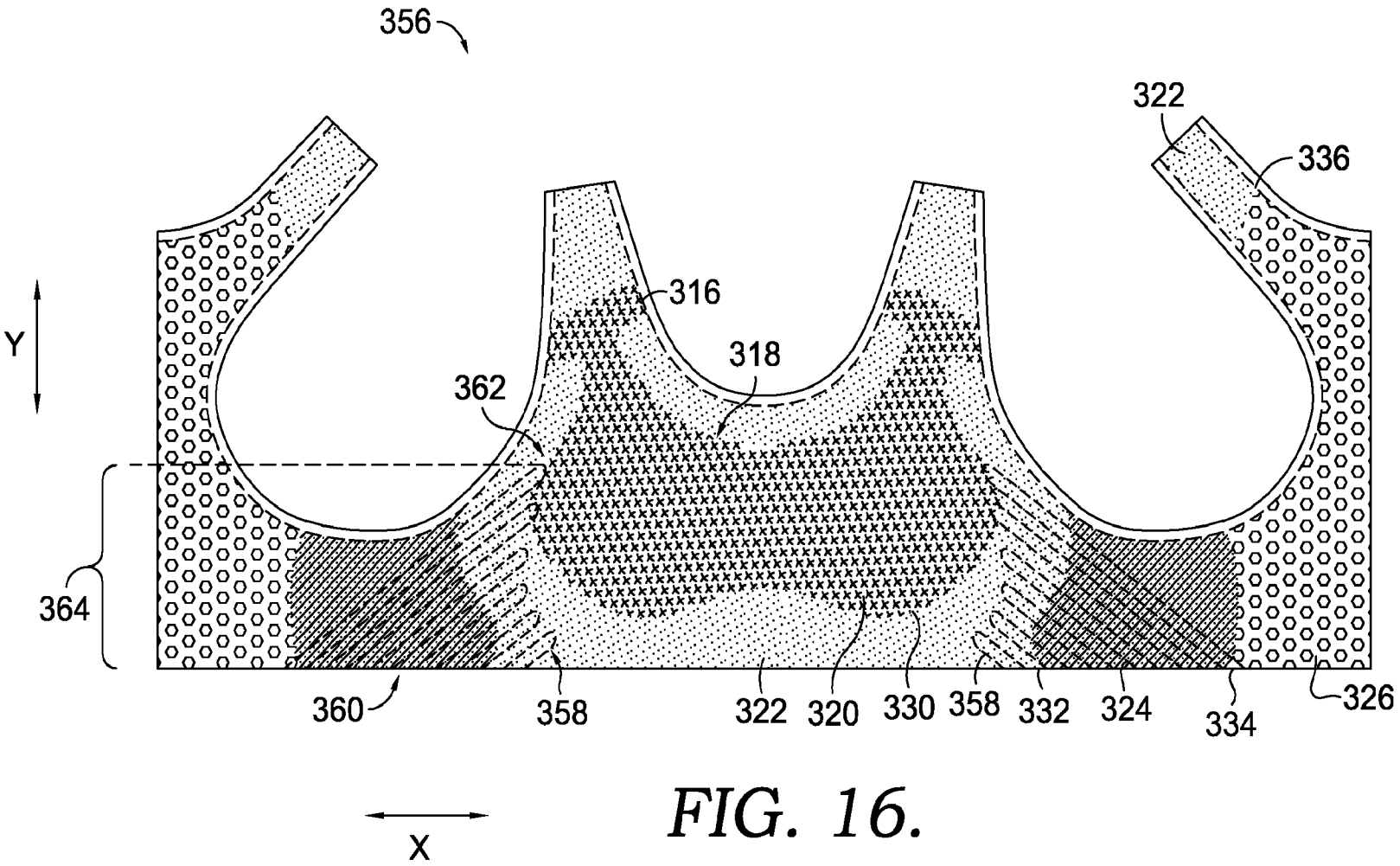
FIG. 16 depicts a top view of the flat-knit bra of FIG. 14, with a plurality of in-lay features, in accordance with various aspects.
Figure 17:
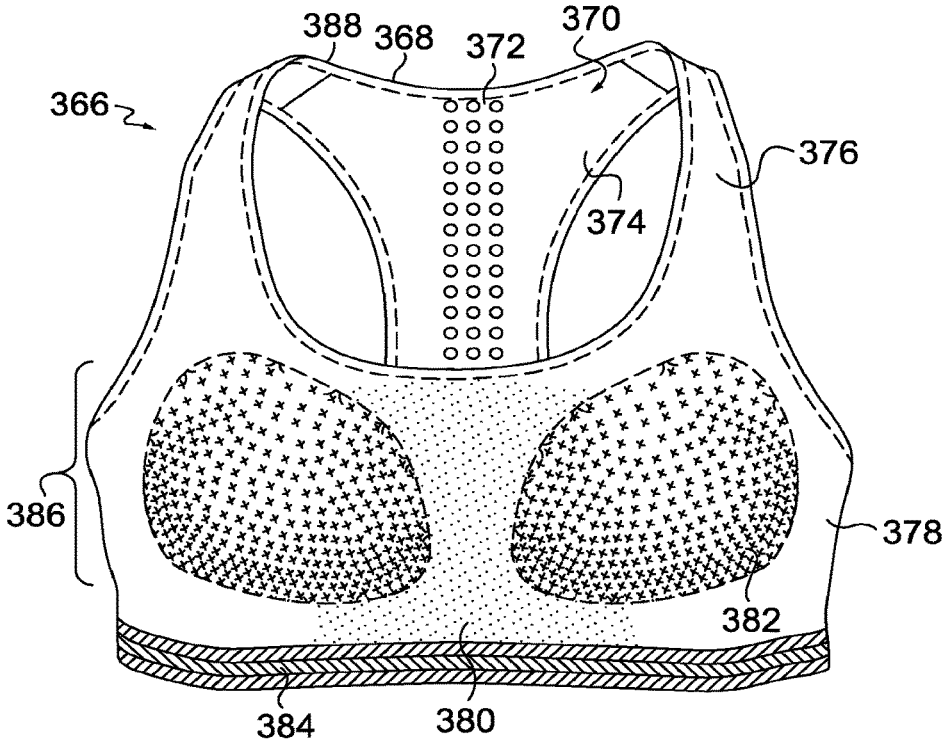
FIG. 17 depicts a front view of an assembled, flat-knit bra with flat-knit shaping prior to molding, in accordance with various aspects.
Figure 18:
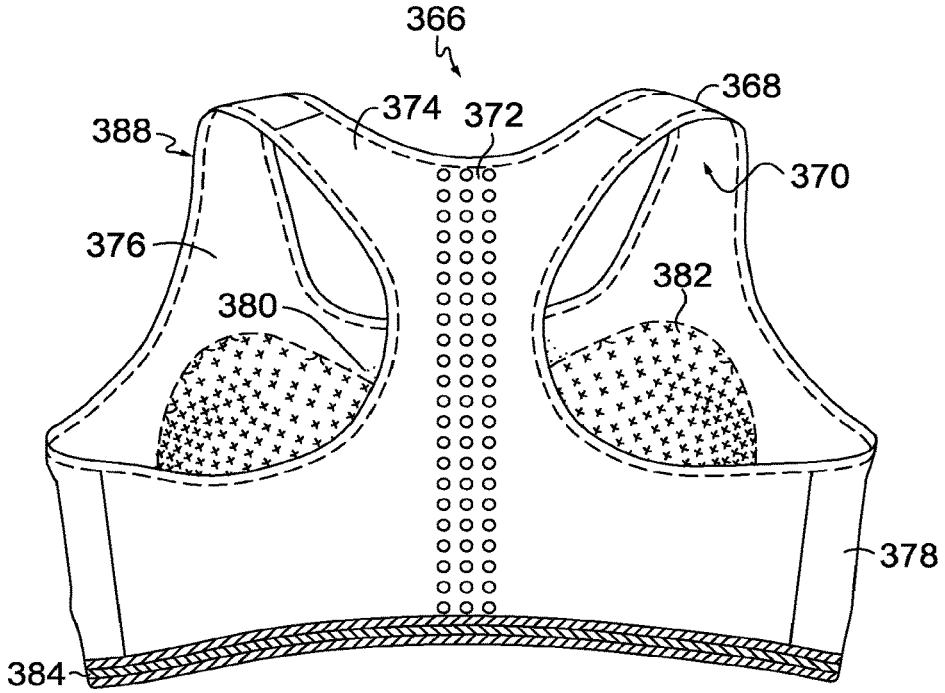
FIG. 18 is a back view of the assembled, flat-knit bra of FIG. 17, in accordance with various aspects.

The flat-knit bra of FIG. 16 depicts the exemplary flat-knit bra of FIG. 14, with a plurality of in-lay features according to various aspects. In particular, the support garment 356 includes one or more in-lay features 358 having an in-lay beginning 360 along the y axis, and an in-lay end 362 along the y axis. The in-lay depth 364 corresponds to the beginning and end of the in-lay feature 358, as inserted during flat knitting across the x axis and carried along the bra material 318 in the 7 direction. In some instances, the in-lay features 358 may be inserted along the x axis or the y axis with respect to the support garment 356. However, in further aspects, an in-lay feature 358 may be integrated within the flat-knit material 318 in a diagonal configuration with respect to x and y axis. The level of additional support provided by the in-lay features 358 may correspond to the material content of such yarns, whether stretch yarns or non-stretch yarns, flexible with the surrounding flat-knit material or otherwise resistant to shaping.

Turning next to the assembled, flat-knit support garment 366 of FIGS. 17-21, various aspects of exemplary flat-knit bras are shown from multiple perspectives and at various phases of molding and/or finishing. While depicted in an assembled view, one or more features of one or more unassembled, flat-knit support garments (e.g., aspects of unassembled, flat-knit support garments described herein) may be included in various aspects of the assembled, flat-knit support garments described with respect to FIGS. 17-21. Similarly, integrated features, zonal characteristics, support zones, transitional boundaries between adjacent support zones, textile elements, shaping structures, and multiple additional characteristics of one or more flat-knit support garments for an upper torso may be included in one or more aspects described, whether depicted in a partial, top, side, back, perspective, and/or dimensional view.

The support garment 366 provides a bra 368 having a bra material 370 with a perforated first back zone 372, a second back zone 374, a strap zone 376, a wing zone 378, an air-permeable midline zone 380, a cup zone 382, and a chestband zone 384. The flat-knit bra 368 also includes a stretch edge 388 adjacent a perimeter of the bra material 370. The stretch edge 388 may continue along some or all of a perimeter of the assembled, bra material 370 as part of the unitary, flat-knit structure of the upper torso support garment 366. As further depicted in FIG. 17, the a molding zone 386 including the cup zone 382 is indicated in a pre-molded state, having puckers around the organic edge of each cup zone 382. The bra 368, when viewed from the back in FIG. 18, includes an amount of flat-knit shaping within the cup zone 382 of the bra material 370, which may be assembled and/or molded without surrounding textile. As such, the bra 368 may be in an unassembled orientation or in an assembled orientation during finishing of the molding zone 386.

Figure 19:
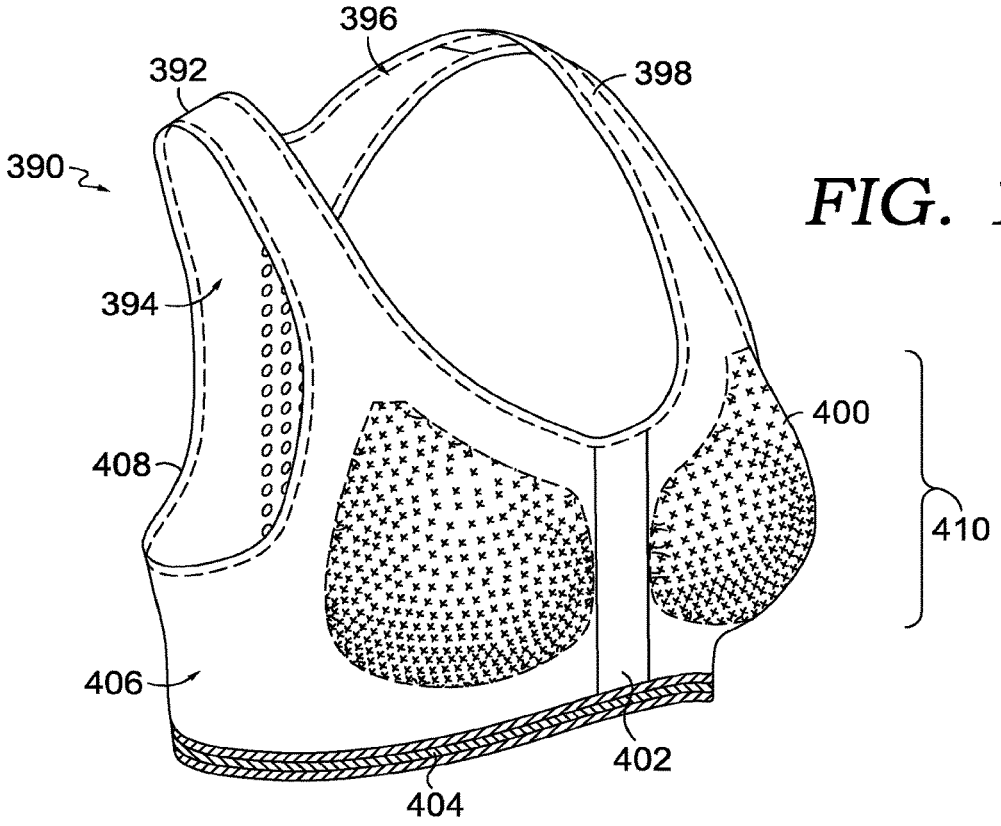
FIG. 19 is a front, perspective view of an assembled and cup-molded, flat-knit bra, in accordance with various aspects.
Figure 20:
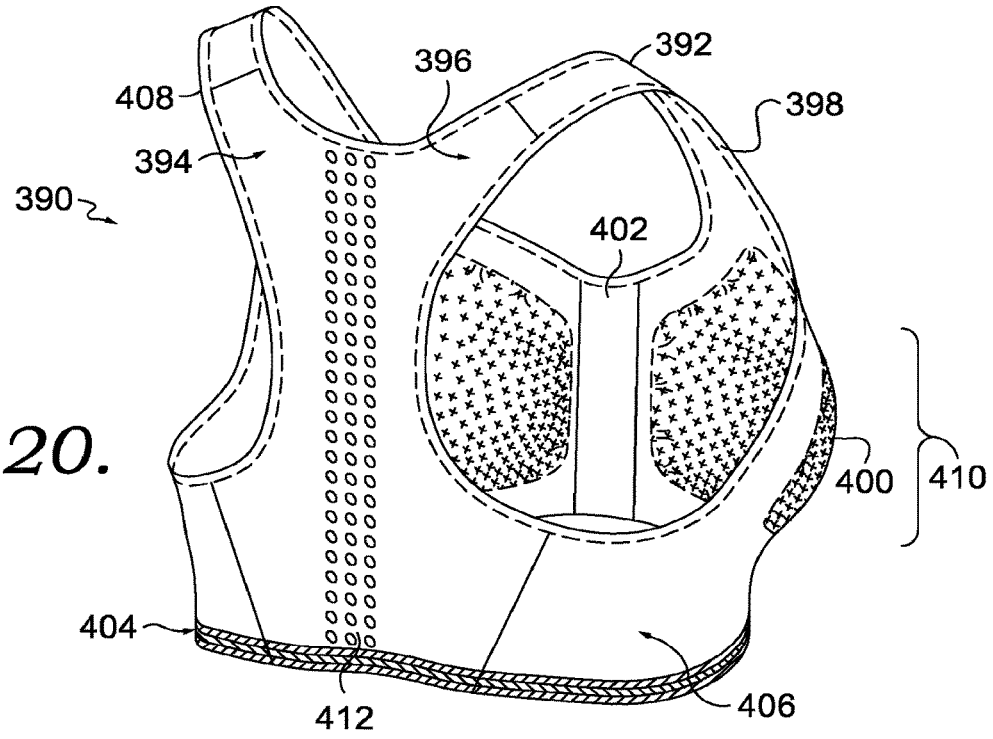
FIG. 20 is a rear, perspective view of the flat-knit bra of FIG. 19, in accordance with various aspects.

Turning next to FIG. 19, a flat-knit support garment 390 includes a bra 392 with a plurality of flat-knit shaping structures integral to the bra material 394. In one instance, the material 394 includes a flat-knitted structure generally oriented in a first plane, while the flat-knit shaping structures add dimension to one or more zones of the bra, displacing those zones into a second plane separate from the first plane. For example, the cup zone 400 may be shaped with respect to the surrounding body zone 402, wing zone 406, strap zone 398, and/or chestband zone 404. In some aspects, the integral stretch edge 408 surrounding the arm openings and neck openings of the bra 392 facilitate the flat knitting of all portions of the bra 392 in a unitary structure. For example a first yarn may be utilized within the bra material 394 to generate shaping, such as the shaping within the cup zone 400. However, the first yarn may include one or more material qualities not desired in a skin-contacting surface of the support garment 390, and the integral stretch edge 408 may be used to transition from the first yarn to a second yarn better suited to contact the wearer. Similarly, one or more yarns used within the molding zone 410 may exhibit more rigid characteristics as compared to the surrounding bra material 394, and the integral stretch edge 408 may provide a seamless transition as well as a more flexible, finished support garment 390. In the back view of FIG. 20, the support garment 390 includes a perforated zone 412 along the back of the bra 293, with flat-knit dimension corresponding to at least the cup zone 400.

Figure 21:
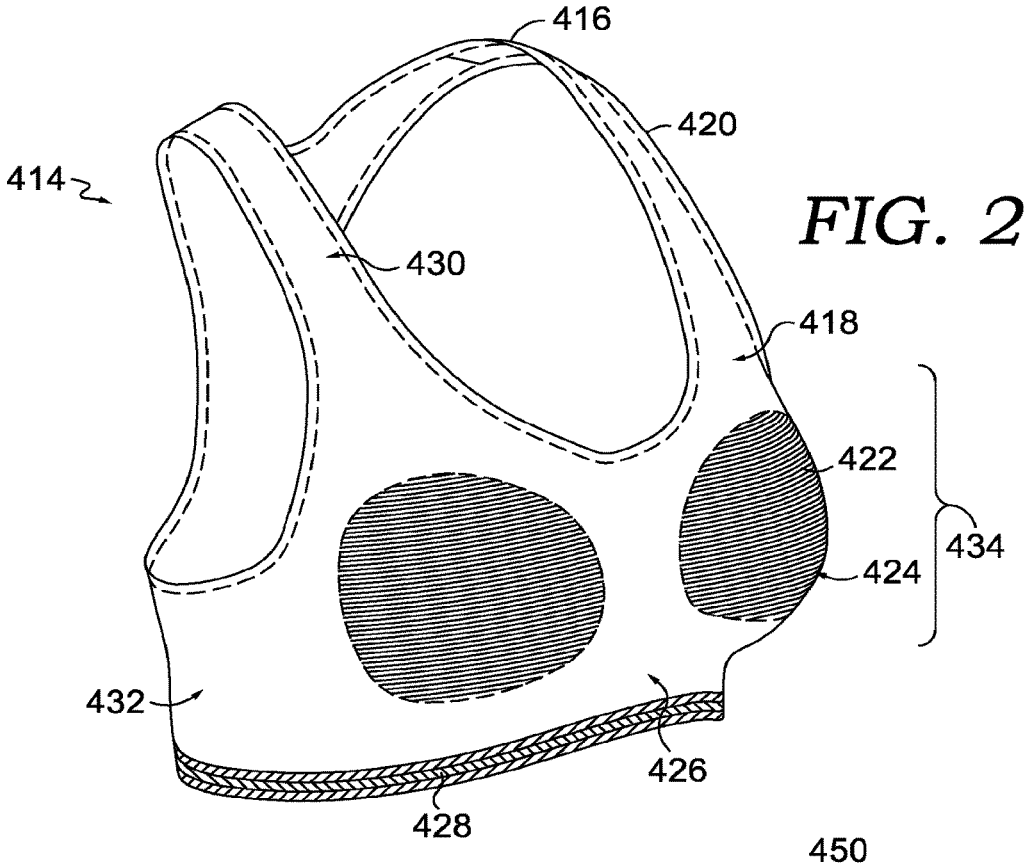
FIG. 21 is a front, perspective view of an assembled, flat-knit bra, in accordance with various aspects.

In the example of FIG. 21, the support garment 414 provides a bra 416 with bra material 418 having a perimeter stretch edge 420, and a cup zone 422 that is enhanced with dimensional knit structure 424. Such dimensional knit structure 424 may include a series of flat-knitted stitch sequences and/or yarn changes or additions that increase a material depth within the cup zone 422. In some aspects, the bra 416 further includes a body zone 426, a chestband zone 428, a strap zone 430, and a wing zone 432, all of which surround and support the flat-knit shaped structure of the cup zone 422 for finishing within the molding zone 434.

Figure 22:
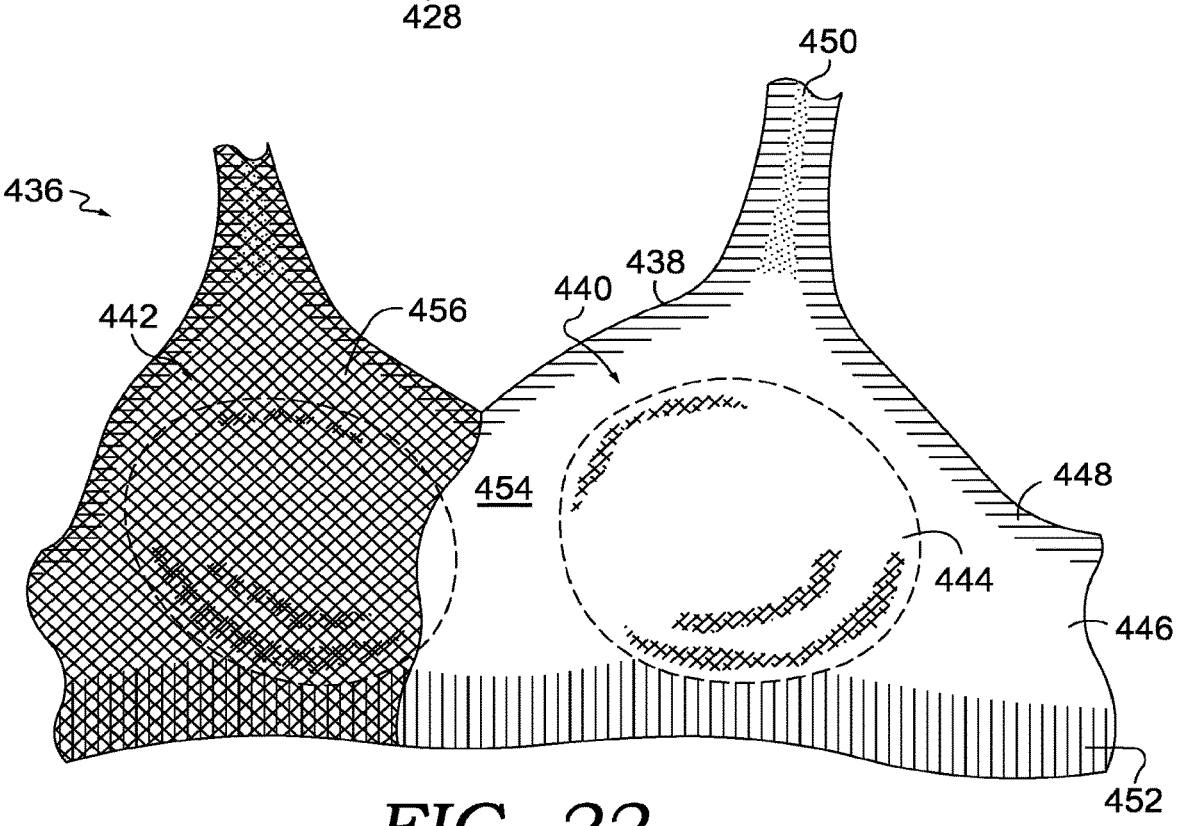
FIG. 22 is a top view of a flat-knit bra with a primary flat-knit layer adjacent a secondary layer, in accordance with various aspects.

FIG. 22 is a top view of a flat-knit bra with a primary flat-knit layer and a secondary layer, in accordance with various aspects. The support garment 436 of FIG. 22 includes a bra 438 having a primary bra material 440, a secondary bra material 442, a cup zone 444, a body zone 446, an edge zone 448, a strap zone 450, and a chestband zone 452. Aspects of the bra 438 may include a rough material hand 454 on the inside of the bra 438, which may be separated from a wearer's torso based on a secondary liner layer 442 having a softer material hand 456. As such, a stretch material of the edge zone 448 may join the primary bra material 440 and the secondary liner layer along an outer edge of the bra 438.

Figure 23:
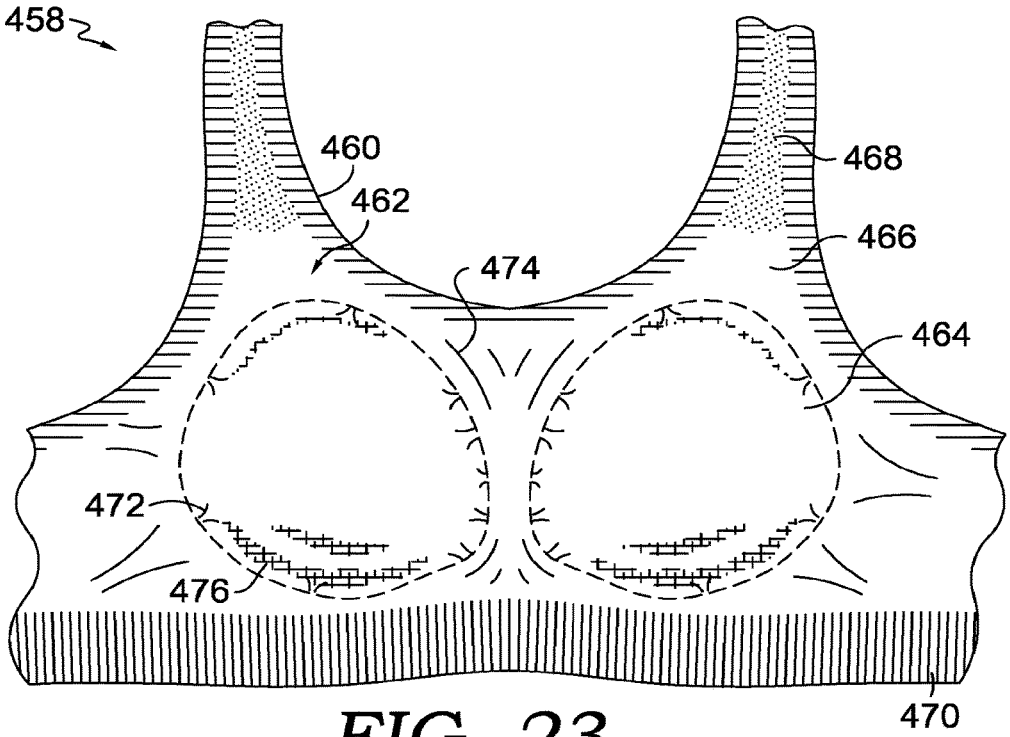
FIG. 23 is a top view of a pre-molded, flat-knit bra with a first amount of flat-knit shaping, in accordance with various aspects.

In some aspects, as shown in FIG. 23, a puckered and pre-molded view of a support garment 458 includes a bra 460 with a bra material 462 in a pre-molded, flat-knit bra configuration, having a first amount of shaping relative to the surrounding material. For example, the bra material 462 may include a cup zone 464 adjacent a body zone 466, a strap zone 468, a chestband zone 470, and a plurality of indications of dimension and/or flat-knit shaping 472. The flat-knit shaping 472 of the cup zone 464 may be measured relative to the unshaped dimensions 474 within the bra material 462. For example, an amount of dimension 476 may be built up within only a portion of the bra material 462, such as within the cup zone 464, with such dimension 476 being an increase in volume of the bra 460 as compared to at least a portion of the bra material 462.

Figure 24:
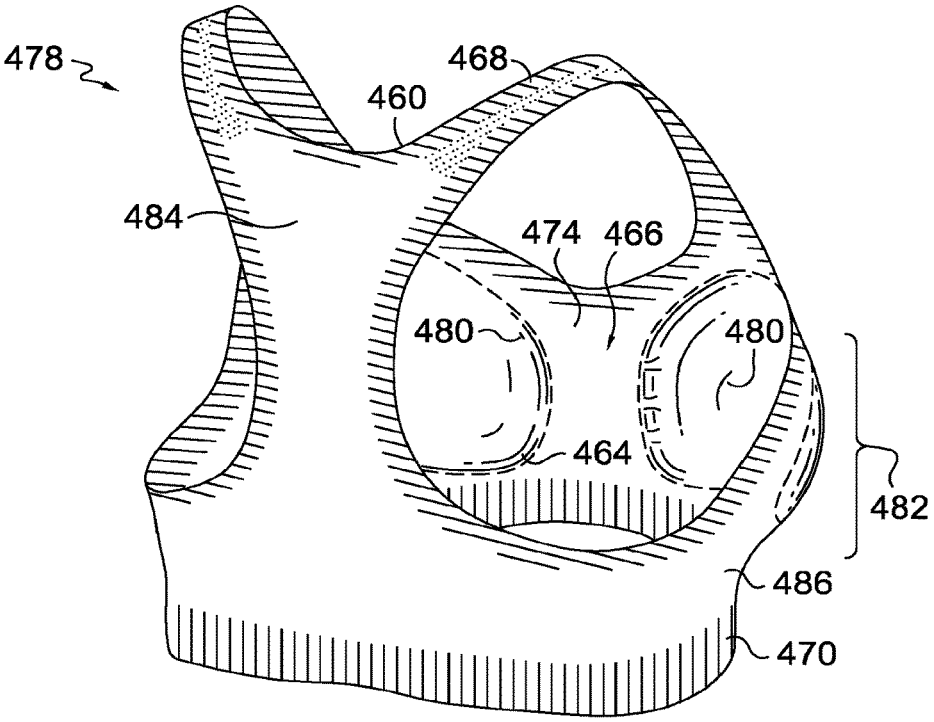
FIG. 24 is a rear, perspective view of the flat-knit bra of FIG. 23, assembled and molded with a second amount of flat-knit shaping, in accordance with various aspects.
Figure 25:
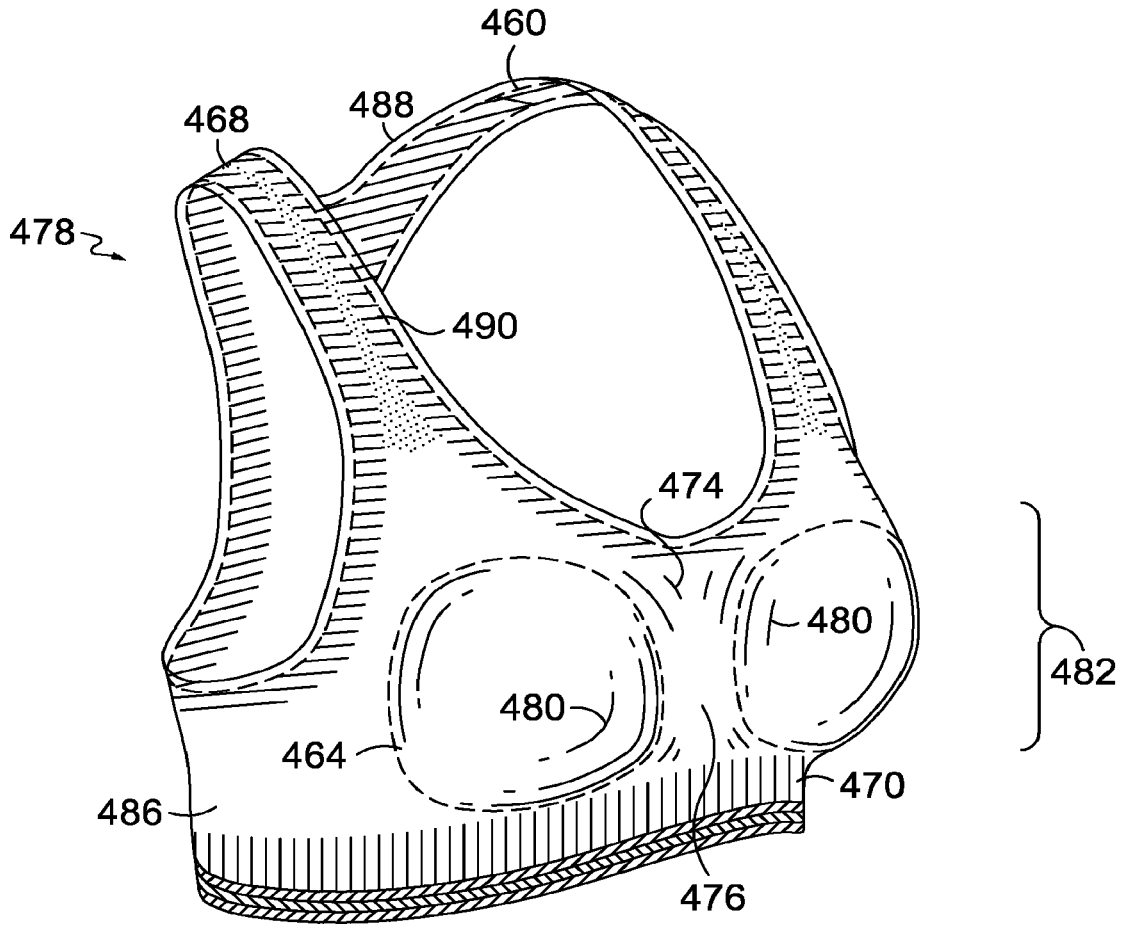
FIG. 25 is a front, perspective view of the flat-knit bra of FIG. 24, in accordance with various aspects.

With reference to the assembled support garment 478 in FIG. 24, the flat-knit bra of FIG. 23 is shown from a rear, perspective view after molding of the cup zones 464 to provide molded cup dimension 480 within the molding zone 482. Similarly, the back zone 484 is positioned to counterbalance the opposing shaping within the cup zone 464, adjacent the wing zone 486 and body zone 466. In the front view of the support garment 478, FIG. 25 depicts the added stretch edge 488 that may be integrally knit with the surrounding flat-knit features of the bra 460. Based on a thickness and/or width of the stretch edge 488, an edge zone 490 may be created adjacent a perimeter of the bra 460, which may maintain particular stretch characteristics in one or more directions after molding within the molding zone 482.

Figure 26:
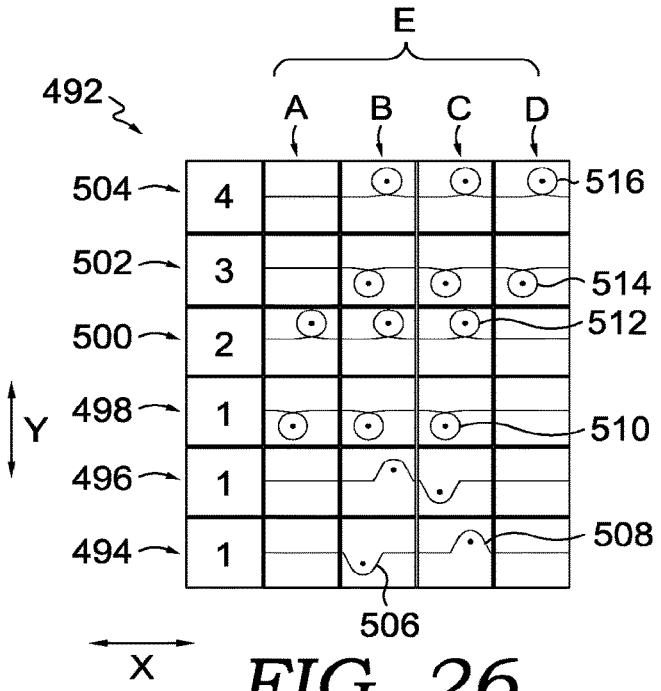
FIG. 26 is an exemplary stitch sequence for at least a portion of a flat-knit bra chestband zone, in accordance with various aspects.

The chestband zone of each aspect of the flat-knit bra discussed thus far has suggested at least one flat-knit feature within the chestband zone, and a seamless transition between at least a portion of the chestband zone and an adjacent bra zone. In the example of FIG. 26, the stitch sequence 492 for at least a portion of a flat-knit bra chestband zone includes a first row 494, a second row 496, a third row 498, a fourth row 500, a fifth row 502, and a sixth row 504. Accordingly, the first row 494 and the second row 496 may be knitted to provide two courses of interlock tuck, prior to the third row 498, fourth row 500, fifth row 502, and sixth row 504 providing four courses of knitting. The stitch sequence 492 further includes needles A, B, C, and D, as part of a repeating pattern E. In some aspects, a chestband for a flat-knit bra may include a front tuck 506, a back tuck 508, a front knit 510, a back knit 512, and an additional front and back knit 514 and 516. The flat-knit bra chestband zone may include two ends of yarn to provide a striping sequence, each yarn adding to the flat-knit structure and resulting stretch modulus of the chestband zone.

Figure 27:
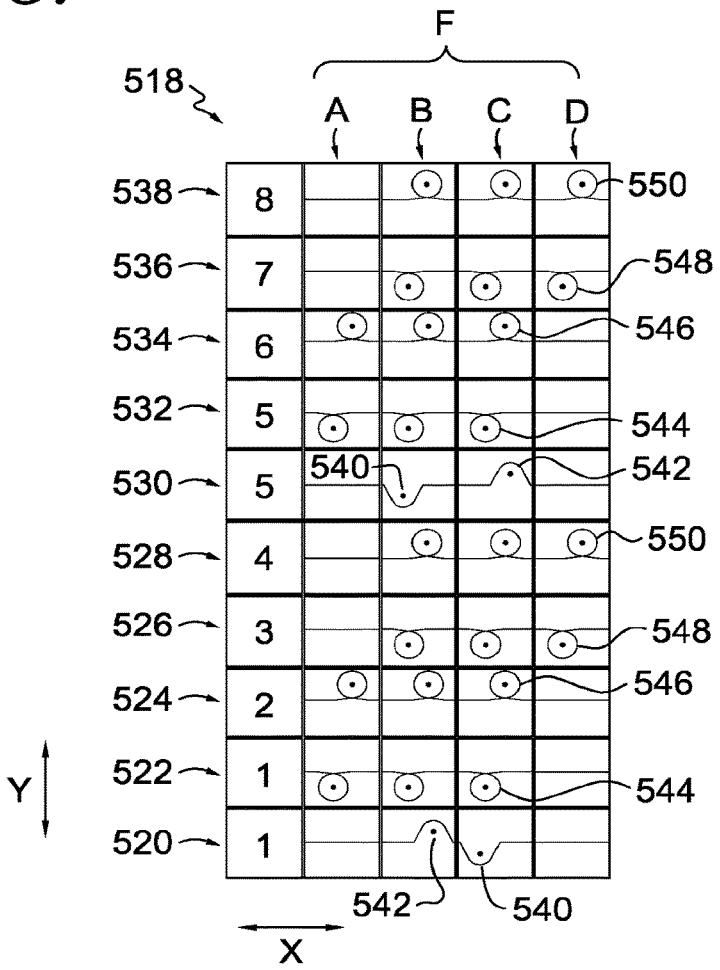
FIG. 27 is an exemplary stitch sequence for at least a portion of a flat-knit bra chestband zone, in accordance with various aspects.

In an expanded stitch sequence 492, FIG. 27 provides at least a portion of a flat-knit bra chestband zone, in accordance with various aspects. The stitch sequence 518 for at least a portion of a flat-knit bra chestband zone includes a first row 520, a second row 522, a third row 524, a fourth row 526, a fifth row 528, a sixth row 530, a seventh row 532, an eighth row 534, a ninth row 536, and a tenth row 538. Accordingly, the first row 520 may be knitted to provide a single course of interlock tuck, followed by four courses of tubular knitting including second row 522, third row 524, fourth row 526, fifth row 528, sixth row 530, seventh row 532, eighth row 534, ninth row 536, and tenth row 538. Further, the exemplary stitch sequence 518 further includes needles A, B, C, and D, as part of a repeating pattern F. In some aspects, a chestband for a flat-knit bra may include a front tuck 540, a back tuck 542, a front knit 544, and a back knit 546. The flat-knit bra chestband zone may include three ends of yarn to provide at least a portion of a desired chestband zone. Additionally, a chestband zone of the upper torso support garment may include at least a portion of the stitch sequence 492, and at least a portion of the stitch sequence 518.

Figure 28:
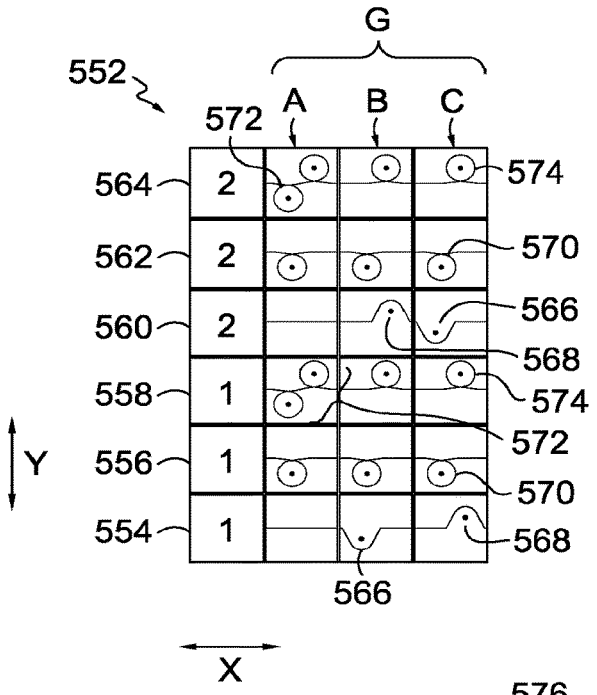
FIG. 28 is an exemplary stitch sequence for at least a portion of a flat-knit bra cup zone, in accordance with various aspects.

Turning next to FIG. 28, an exemplary stitch sequence 552 for at least a portion of a flat-knit bra cup zone is provided in accordance with various aspects. The stitch sequence 552 includes a first row 554, a second row 556, a third row 558, a fourth row 560, a fifth row 562, and a sixth row 564. Additionally, the stitch sequence 552 includes a repeating pattern of needles A, B, and C, which corresponds to various front tucks 566, back tucks 568, front knits 570, transfers 572, and back knits 574. The flat-knit bra cup zone stitch sequence 552 may include one or more yarn types for flat knitting in a variety of cup zone formations. For example, a nylon-covered Spandex yarn may be knitted along a back needle bed, while an uncovered yarn is knitted on the front needle bed. In other aspects, a flat-knit bra cup zone may include uncovered yarn in both the front and back needle beds. One or more stitches of the stitch sequence 552 may be used to create shaping within the cup zone, such as an amount of shaping created using partial knitting. In some aspects, partial knitting, short rows, and/or extra knitting may refer to the additional knitted stitches within the cup zone of the support garment, which may be knitted at any portion of the cup zone. That is, the shaping features created using partial knitting may be organically positioned with respect to the shape of the cup zone, such as a zonal shaping with respect to a lower portion of the cup zone.

In some aspects, the cup zone stitch sequence 552 may include one or more variations, such as covered and uncovered yarns, full knitting sequences vs. partial knitting sequences, a flat-knit bra material knitted with intarsia on one bed of the knitting needles and a partial knitting sequence generating shaping within the cup zone, and the like. In some instances, the cup zone stitch sequence 552 may be repeated across an entire width of the cup zone in a flat-knit bra material, and transitioning along the boundaries of the cup zone to a different stitch sequence (i.e., that of the adjacent flat-knit body zone stitch sequence). Accordingly, the repeating pattern G of FIG. 28 may be carried across a width of a cup zone having an organic shape with respect to the surrounding bra structure, flat-knit with a curved boundary, for example, and integrally changing from one stitch sequence and/or configuration to another as zones change across a row of knitting.

Figure 29:
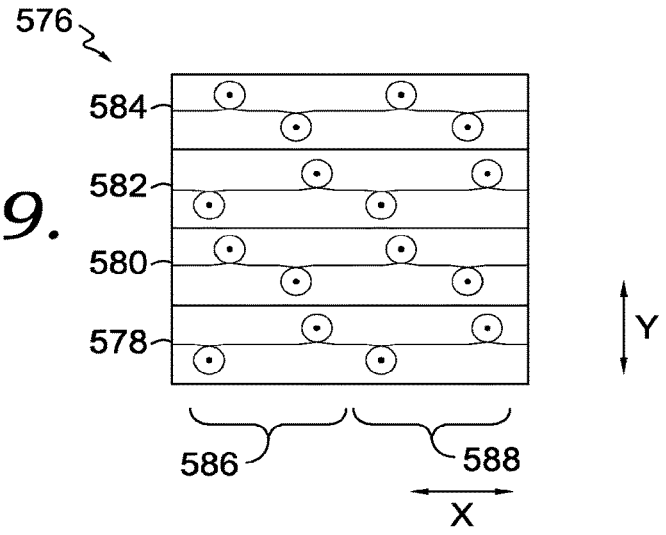
FIG. 29 is an exemplary stitch sequence for at least a portion of a flat-knit bra main back zone, in accordance with various aspects.

In FIG. 29, an exemplary stitch sequence 576 for at least a portion of a flat-knit bra main back zone is provided, having a first row 578, second row 580, third row 582, and fourth row 584, with a repeating stitch pattern across the first needle set 586 and the second needle set 588. In some instances, the back main interlock stitch sequence 576 of a flat-knit bra may be adjacent a back selvedge sequence of the stitch sequence 590 in FIG. 30. The exemplary stitch sequence 590 includes a first row 592, a second row 594, a third row 596, and a fourth row 598, which repeat across a first needle set 600 and a second needle set 602. The back selvedge stitch sequence 590 may be used in finishing a flat-knit edge of the flat-knit bra material, and/or in transitioning between one flat-knit zone and another. In some aspects, the back zone stitch sequence may be constructed using two ends of covered yarn.

Figure 30:
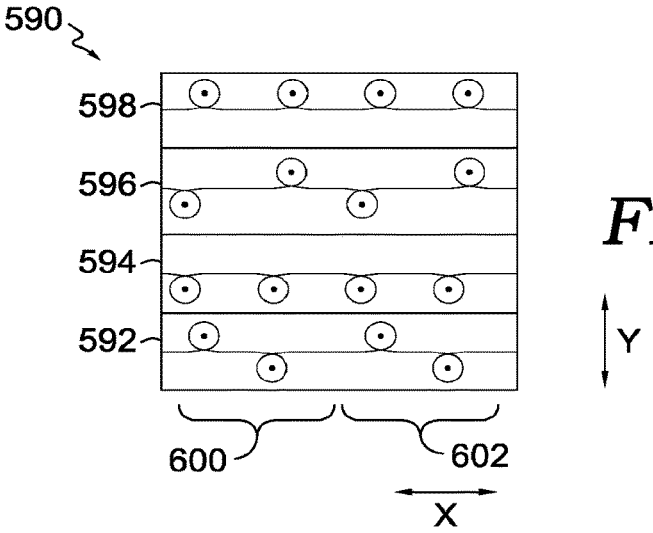
FIG. 30 is an exemplary stitch sequence for at least a portion of a flat-knit bra selvedge back zone, in accordance with various aspects.
Figure 31:
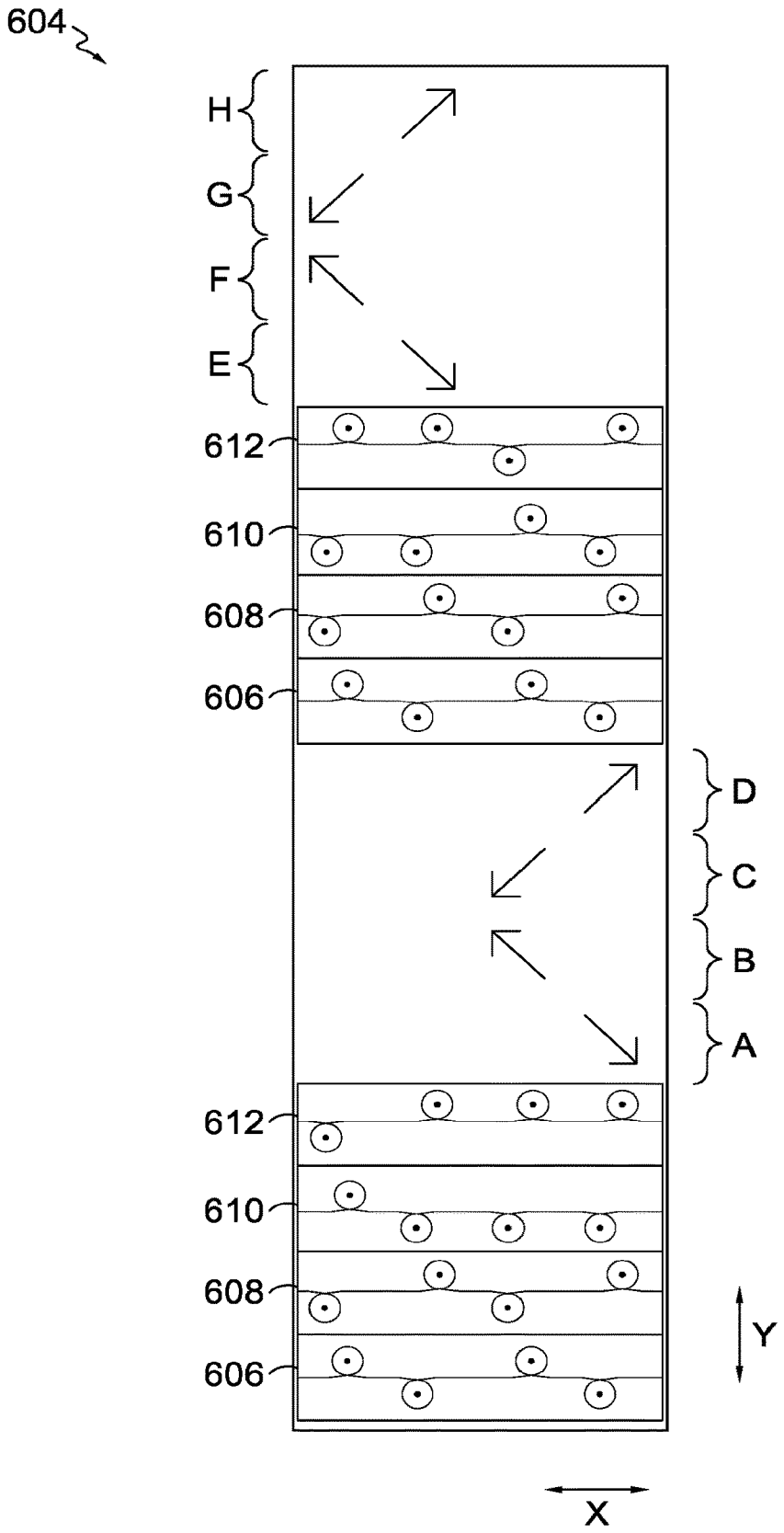
FIG. 31 is an exemplary stitch sequence for at least a portion of a flat-knit bra mesh back zone, in accordance with various aspects.

Finally, an exemplary stitch sequence 604 is depicted in FIG. 30, and may be used to direct the flat knitting of at least a portion of a flat-knit bra mesh back zone, in accordance with various aspects. The back mesh stitch sequence 604 includes a first row 606, a second row 608, a third row 610, a fourth row 612, and transfer portions A, B, C, and D. In the repeated sequence of FIG. 31, upon completion of transfer portion D, the mesh sequence of flat knitting continues with the stitch sequence including first row 606, second row 608, third row 610, fourth row 612, and transfer portions E, F, G, and H as the flat knitting of the back mesh stitch sequence 604 continues in the direction of the y axis and in the rows of knitting across the x axis.

The examples of stitch sequences provided here, with repeating patterns for flat knitting of a chestband zone, a cup zone, a back main interlock zone, a back selvedge zone, and a back mesh zone, may be used in isolation or in combination within adjacent stitch structure of the flat-knit support garment to create one or more different characteristics of the flat-knit bra, such as a target stretch modulus of a particular zone of the bra, a location of particular support structure integral to the bra material, a desired stretch modulus characteristic of a particular portion of the flat-knit zones within a bra, a/or a desired lockout and/or support level resisting stretch within the bra material. While aspects of the exemplary stitch structures in FIGS. 26-31 are not limiting to any additional or alternative stitch structures within a flat-knit support garment for an upper torso, such stitch structures are provided here as an example of flat-knitting techniques used to vary the properties of the knitted material associated with different portions of the bra—i.e., the cup zone having different flat-knit stitch construction than the chestband zone, etc. In some aspects, the stitch structure of a particular portion of the flat-knit bra may impact the adjacent stitch structure and any transitional zone and/or boundary flat-knit region between the two zones. Such transitional zones may be incorporated into the flat-knit bra, and other support garments for an upper torso.

Any and all aspects of a flat-knit bra, and any variation thereof, are contemplated as being within the scope described here. Moreover, it is contemplated that any number of stitch types or yarn types may be used throughout the flat-knit bra and within the various support zones/regions. Aspects of the present invention have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all assembly or construction steps listed in the various figures need be carried out in a specific order described.

What is claimed is:

1. An upper-torso garment comprising:

a double-knit textile element having a set of front courses and a set of back courses, the double-knit textile element comprising:

a first knit zone comprising a breast covering portion and having a first modulus of elasticity arising at least partly from a first stitch sequence within the first knit zone; and a second knit zone comprising a chest band and having a second modulus of elasticity arising at least partly from a second stitch sequence within the second knit zone, the second knit zone being integrally knit with the first knit zone, wherein the first stitch sequence comprises a plurality of interlocking tuck stitches that bind a front course to a respective back course, wherein the plurality of interlocking tuck stitches comprises:

a first set of front tuck stitches and a first set of back tuck stitches on a first course within the first knit zone, and a second set of front tuck stitches and a second set of back tuck stitches on a second course within the first knit zone, wherein the first set of front tuck stitches is offset from the second set of front tuck stitches and the first set of back tuck stitches is offset from the second set of back tuck stitches.

2. The upper-torso garment of claim 1, wherein the first course is immediately adjacent the second course.

3. The upper-torso garment of claim 1, wherein the first course and the second course are separated by one or more courses without interlocking tuck stitches.

4. The upper-torso garment of claim 1, wherein the first knit zone comprises a first yarn type and the second knit zone comprises a second yarn type.

5. The upper-torso garment of claim 1, wherein the first stitch sequence further comprises a quantity of transfers of a yarn between a front course and a respective back course.

6. The upper-torso garment of claim 5, wherein the quantity of transfers in the first stitch sequence comprises one transfer within three stitch locations.

7. The upper-torso garment of claim 5, wherein the second stitch sequence comprises zero transfers of yarn.

8. The upper-torso garment of claim 1, wherein the double-knit textile element further comprises a third knit zone comprising a back portion.

9. An upper-torso garment comprising:

a double-knit textile element having a set of front courses and a set of back courses, the double-knit textile element comprising:

a first knit zone comprising a breast covering portion and having a first modulus of elasticity arising at least partly from a first stitch sequence within the first knit zone;

a second knit zone comprising a chest band and having a second modulus of elasticity arising at least partly from a second stitch sequence within the second knit zone, the second knit zone being integrally knit with the first knit zone; and a third knit zone comprising a back portion and having a third modulus of elasticity arising at least partly from a third stitch sequence within the third knit zone, wherein the first stitch sequence comprises a plurality of interlocking tuck stitches that bind a front course to a respective back course, wherein the plurality of interlocking tuck stitches comprises:

a first set of front tuck stitches and a first set of back tuck stitches on a first course within the first knit zone, and a second set of front tuck stitches and a second set of back tuck stitches on a second course within the first knit zone, wherein the first set of front tuck stitches is offset from the second set of front tuck stitches and the first set of back tuck stitches is offset from the second set of back tuck stitches.

10. The upper-torso garment of claim 9, wherein the first course is immediately adjacent the second course.

11. The upper-torso garment of claim 9, wherein the first course and the second course are separated by one or more courses without interlocking tuck stitches.

12. The upper-torso garment of claim 9, wherein the first knit zone comprises a first yarn type, the second knit zone comprises a second yarn type, and the third knit zone comprises a third yarn type.

13. The upper-torso garment of claim 9, wherein the first stitch sequence further comprises a quantity of transfers of a yarn between a front course and a respective back course.

14. The upper-torso garment of claim 13, wherein the second stitch sequence comprises zero transfers of yarn.

15. The upper-torso garment of claim 9, wherein the first knit zone further comprises a plurality of shorter rows of knit stitches arranged between longer rows of knit stitches.

16. A flat-knit upper-torso garment comprising:

a double-knit textile element having a set of front courses and a set of back courses, the double-knit textile element comprising:

a first knit zone comprising a breast covering portion and having a first modulus of elasticity arising at least partly from a first stitch sequence within the first knit zone; and a second knit zone comprising a chest band and having a second modulus of elasticity arising at least partly from a second stitch sequence within the second knit zone, the second knit zone being integrally knit with the first knit zone, wherein the first stitch sequence comprises a plurality of interlocking tuck stitches that bind a front course to a respective back course, wherein the plurality of interlocking tuck stitches comprises:

a first set of front tuck stitches and a first set of back tuck stitches on a first course within the first knit zone, and a second set of front tuck stitches and a second set of back tuck stitches on a second course within the first knit zone, wherein the first set of front tuck stitches is offset from the second set of front tuck stitches and the first set of back tuck stitches is offset from the second set of back tuck stitches; and wherein the double-knit textile element comprises one or more flat-knit edges adjacent at least a portion of the second knit zone.

17. The flat-knit upper-torso garment of claim 16, wherein the first course is immediately adjacent the second course.

18. The flat-knit upper-torso garment of claim 16, wherein the double-knit textile element further comprises a third knit zone comprising a back portion and having a third modulus of elasticity arising at least partly from a third stitch sequence.

19. The flat-knit upper-torso garment of claim 16, wherein the one or more flat-knit edges comprise an uncovered spandex yarn and wherein the portion of the second knit zone adjacent the one or more flat-knit edges comprises a covered yarn.

20. The flat-knit upper-torso garment of claim 16, wherein the one or more flat-knit edges comprises one or more finished edges without sewn-on binding or separate trim pieces.

* * * * *